United States Patent [19]

Yagi et al.

[11] Patent Number: 4,917,056

[45] Date of Patent: Apr. 17, 1990

[54] VALVE OPERATION CONTROL SYSTEM IN INTERNAL COMBUSTION ENGINE

[75] Inventors: Toru Yagi; Yoshiaki Hirosawa; Kaname Tokita; Yoshihiro Fujiyoshi, all of Saitama, Japan

[73] Assignee: Honda Giken Kogyo Kabushiki Kaisha, Tokyo, Japan

[21] Appl. No.: 247,952

[22] Filed: Sep. 22, 1988

[30] Foreign Application Priority Data

| | | | |
|---|---|---|---|
| Sep. 22, 1987 | [JP] | Japan | 62-237706 |
| Jun. 1, 1988 | [JP] | Japan | 63-135253 |
| Jun. 10, 1988 | [JP] | Japan | 63-143862 |
| Jun. 27, 1988 | [JP] | Japan | 63-158324 |
| Jun. 30, 1988 | [JP] | Japan | 63-136835 |

[51] Int. Cl.[4] ..... F01L 1/34

[52] U.S. Cl. ..... 123/90.16; 123/90.44; 123/198 F; 123/90.11

[58] Field of Search ..... 123/90.11, 90.12, 90.16, 123/90.44, 90.47, 198 F

[56] References Cited

U.S. PATENT DOCUMENTS

| | | | |
|---|---|---|---|
| 3,658,038 | 4/1972 | Bergmann | 123/90.55 |
| 4,192,263 | 3/1980 | Kitagawa et al. | 123/90.44 |
| 4,387,680 | 6/1983 | Tsunetomi et al. | 123/198 F |
| 4,466,390 | 8/1984 | Babitzka et al. | 123/90.16 |
| 4,556,025 | 12/1985 | Morita | 123/90.16 |
| 4,567,861 | 2/1986 | Hara et al. | 123/90.16 |
| 4,611,558 | 9/1986 | Yosahizaki et al. | 123/90.16 |
| 4,612,884 | 9/1986 | Ajiki et al. | 123/90.16 |
| 4,671,221 | 6/1987 | Geringer et al. | 123/90.16 |
| 4,711,207 | 12/1987 | Bonvallet | 123/90.16 |
| 4,724,822 | 2/1988 | Bonvallet | 123/90.16 |

FOREIGN PATENT DOCUMENTS

| | | | |
|---|---|---|---|
| 3148720 | 7/1983 | Fed. Rep. of Germany | 123/198 F |
| 59-52111 | 4/1984 | Japan . | |
| 0168208 | 9/1984 | Japan | 123/90.16 |

*Primary Examiner*—Charles J. Myhre
*Assistant Examiner*—Weilun Lo
*Attorney, Agent, or Firm*—Lyon & Lyon

[57] ABSTRACT

A valve operation control system in an internal combustion engine, comprising an engine valve openably and closably supported on an engine body, a valve spring for biasing the engine valve in a valve closing direction, and valve driving means interposed between a valve-operating cam and the engine valve to transmit a force in the valve-opening direction provided by the valve-operating cam to the engine valve. The valve driving means includes a valve-opening resilient member for exhibiting a repulsive force in a direction to open the engine valve, and closed-position retaining means is interposed between the engine valve and the valve operating cam for retaining the engine valve at its closed position, with a valve-opening force provided by the valve-operating cam being accumulated by the valve-opening resilient member. The closed-position retaining means is arranged to be switchable between a retaining state and a releasing state to control the timing of opening the engine valve depending upon the operational condition of the engine.

33 Claims, 32 Drawing Sheets

VALVE OPERATION CONTROL SYSTEM IN INTERNAL COMBUSTION ENGINE

BACKGROUND OF THE INVENTION

1. Field of the Invention

The present invention relates to a valve operation control system in an internal combustion engine, comprising an engine valve openably and closably supported on an engine body, a valve spring for biasing the engine valve in a valve-closing direction, and valve driving means interposed between a valve-operating cam and the engine valve to transmit a force in the valve-opening direction provided by the valve operating cam to the engine valve.

2. Description of the Prior Art

There is already known, from Japanese Utility Model Application Laid-open No. 52111/84 or the like, a valve operation control system Which provides controlling of opening and closing an intake valve or an exhaust valve as an engine valve not only by the coaction of a valve-operating cam and a valve spring but also by the operation of an electromagnetic actuator depending upon the operational state of an engine.

The present applicant has proposed an engine valve-opening and -closing operation control system of the type described above (Japanese patent Application No. 123647/87) in which an attractive force of an electromagnetic actuator is utilized at a maximum to provide an improvement in performance of an engine. However, the system is accompanied by a problem that a valve-closing timing can be controlled, but it is impossible to provide a variable control of valve-opening timing where an inertial supercharging can be put to practical use, because the engine valve is opened by excitation of the electromagnetic actuator and closed by a spring force as a result of releasing of such excitation.

SUMMARY OF THE INVENTION

It is therefore an object of the present invention to provide a valve operation control system of a simplified construction in an internal combustion engine, wherein a further improvement is added to the above-described system to overcome the above problem.

To accomplish the above object, the present invention provides a valve operation control system in an internal combustion engine, comprising an engine valve openably and closably supported on an engine body, a valve spring for biasing the engine valve in a valve-closing direction, and valve driving means interposed between a valve-operating cam and the engine valve to transmit a force of the valve-opening direction provided by the valve operating cam to the engine valve, wherein the valve driving means includes a valve-opening resilient member for exhibiting a repulsive force in a direction to open the engine valve, and the system includes closed-position retaining means interposed between the engine valve and the valve-operating cam for retaining the engine valve in its closed position, with any valve-opening force provided by the valve-operating cam being accumulated by the valve-opening resilient member, the closed-position retaining means being arranged to be switchable between a retaining state and a releasing state to control the timing of opening the engine valve depending upon the operational state of the engine.

With such construction, controlling of the timing of releasing the retaining of the closed position by the closed-position retaining means makes it possible to set a valve-opening timing most suitable for any operational state of the engine, thereby improving the intake or exhaust inertial effect to increase the intake or exhaust efficiency.

It is another object of the present invention to moderate the opening of the engine valve upon releasing of the retaining by the closed-position retaining means, thereby preventing the engine valve from being damaged.

It is a further object of the present invention to open and close the engine valve in accordance with a profile of the valve-operating cam when the closed-position retaining means is inoperative.

It is a yet further object of the present invention to enable not only the timing of opening the engine valve but also the timing of closing it to be controlled, thereby providing a further improvement in intake or exhaust efficiency.

The above and other objects, features and advantages of the invention will become apparent from a reading of the following description of the preferred embodiments, taken in conjunction with the accompanying drawings.

BRIEF DESCRIPTION OF THE DRAWINGS

FIGS. 1 to 7 illustrate a first embodiment of the present invention, wherein FIG. 1 is a longitudinal sectional side view of a valve operation control system;

FIG. 2 is a sectional view taken along a line II—II in FIG. 1;

FIG. 3 is an enlarged view of a portion indicated by an arrow III in FIG. 1;

FIG. 4 is a sectional view of an essential portion for illustrating a lock mechanism added to valve driving means;

FIG. 5 is a graph illustrating a relationship between the amount of lift and the angle of rotation of a valve-operating cam shaft;

FIG. 6 is a longitudinal sectional side view similar to FIG. 1, but with a valve-closed position being retained by closed-position retaining means; and FIG. 7 is a longitudinal sectional side view similar to FIG. 1, but with the retaining of the valve closed position by closed-position retaining means being released;

FIGS. 14 to 19 illustrate a sixth embodiment of the present invention, wherein FIG. 14 is a longitudinal sectional side view similar to FIG. 1;

FIG. 15 is a view taken along a line XV—XV in FIG. 14;

FIG. 16 is a sectional view taken along a line XVI—XVI in FIG. 15;

FIG. 17 is a sectional view taken along a line XVII—XVII in FIG. 15;

FIG. 18 is a longitudinal sectional view similar to FIG. 14, but with a valve-closed position being retained by closed-position retaining means; and FIG. 19 is a longitudinal sectional view similar to FIG. 14, but with retaining of the valve-closed position by closed-position retaining means being released;

FIGS. 22 to 26 illustrate a ninth embodiment of the present invention, wherein

FIG. 22 is a longitudinal sectional side view in a valve-closed state;

FIG. 23 is a longitudinal sectional side view with a valve-closed position being retained by closed-position retaining means;

FIG. 24 is a longitudinal sectional side view with retaining of the valve-closed position by the closed-position retaining means being released;

FIG. 25 is a longitudinal sectional side view similar to FIG. 22, but with the lock mechanism being operative; and FIG. 26 is a longitudinal sectional side view similar to FIG. 24, but with the lock mechanism being operative;

FIGS. 28 to 30 illustrate an eleventh embodiment of the present invention, wherein FIG. 28 is a longitudinal sectional side view with a valve closed-position being retained by closed-position retaining means;

FIG. 29 is a longitudinal sectional side view similar to FIG. 28, but illustrating an engine valve which is being opened after the retaining of the valve closed-position by the closed-position retaining means has been released; and FIG. 30 is a longitudinal sectional side view similar to FIG. 28, but when the engine valve is in its fully opened state;

FIGS. 31 to 34 illustrate a twelfth embodiment of the present invention, wherein FIG. 31 is a longitudinal sectional side view;

FIG. 32 is a graph illustrating a relationship between the angle of rotation of a valve-operating cam and the amount of lift of an engine valve;

FIG. 33 is a longitudinal sectional side view similar to FIG. 31, but with a valve closed-position being retained by closed-position retaining means; and FIG. 34 is a longitudinal sectional side view similar to FIG. 31, but with retaining of the valve-closed position by the closed-position retaining means being released;

DESCRIPTION OF THE PREFERRED EMBODIMENTS

Figure 1:
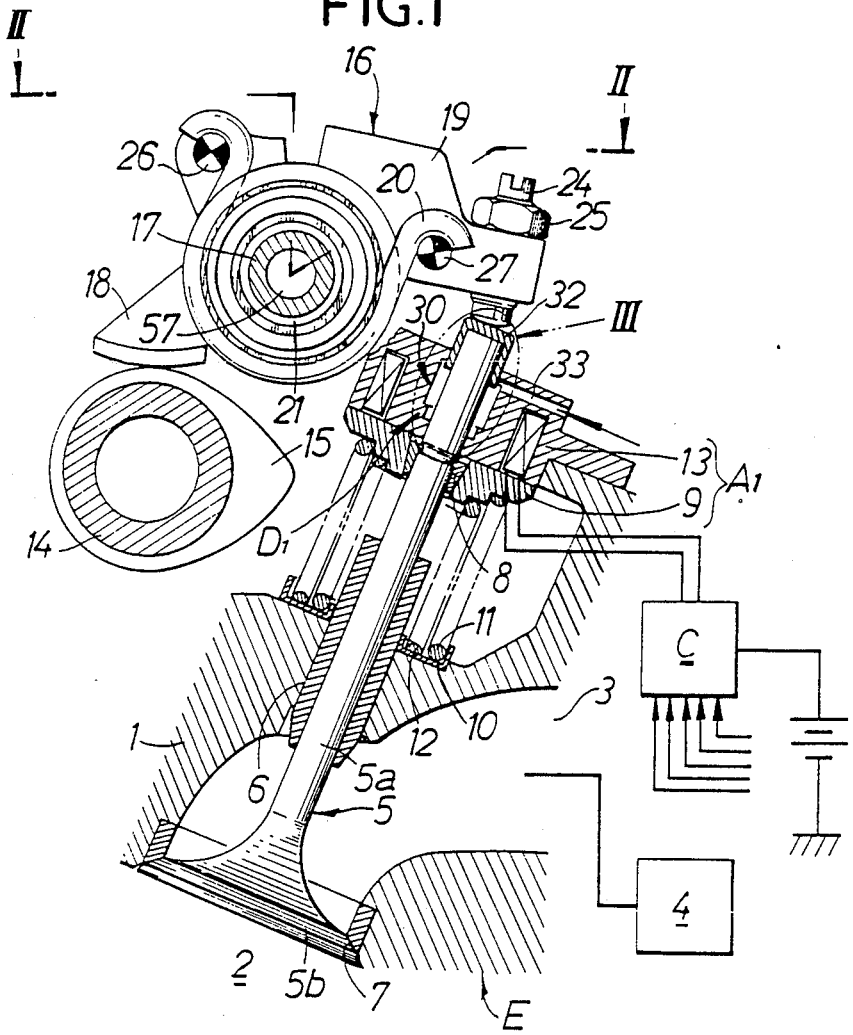

Embodiments of the present invention will now be described with reference to the accompanying drawings. Referring first to FIG. 1 illustrating a first embodiment of the present invention, a combustion chamber 2 and an intake port 3 communicating with the combustion chamber 2 are defined in a cylinder head 1 of an engine body E. The intake port 3 is connected to an intake system including a fuel feeder 4. The cylinder head 1 is provided with an intake valve 5 serving as an engine valve adapted to open and close an opened end, of the intake port 3 which is closer to the combustion chamber 2. The intake valve 5 is comprised of a valve stem 5*a* and a valve plug 5*b*. The valve stem 5*a* is slidably received in a valve guide 6 secured to the cylinder head 1, while the valve plug 5*b* is adapted to seat on a valve seat 7 at the opened end of the intake port 3 closer to the combustion chamber 2, from the side of the combustion chamber 2. A spring retainer 9 is mounted on an upper end of the valve stem 5*a* through a cotter 8. Valve springs 11 and 12 each comprising a compression coiled spring are provided in compression between the spring retainer 9 and a spring seat 10 formed on the cylinder head 1 in a facing relation to the spring retainer 9, so that repulsive forces of the valve springs 11 and 12 bias the intake valve 5 in a closing direction. The spring retainer 9 is formed of a magnetic element and constructs an electromagnetic actuator A1 as closed-position retaining means by cooperation with an electromagnet 13 which will be described hereinafter.

A valve-operating cam shaft 14 operatively connected to a crank shaft (not shown) is rotatably carried on a cam holder (not shown) provided on the cylinder head 1. Valve driving means 16 is interposed between an intake cam 15 as a valve-operating cam integrally formed on the valve-operating cam shaft 14 and the intake valve 5 for transmitting a force in an opening direction provided by the intake cam 15 to the intake valve 5.

The valve driving means 16 comprises a rocker shaft 17 fixedly disposed in parallel to and above the valve-operating cam 15 between the valve-operating cam shaft 14 and the intake valve 5, a first rocker arm 18 carried on the rocker shaft 17 to rock in sliding contact with the intake cam 15, a second rocker arm 19 carried on the rocker shaft 17 to rock while abutting against an upper end of the intake valve 5, and torsion springs 20 as valve-opening resilient members interposed between both the rocker arms 18 and 19 to exhibit a spring force in a direction to open the intake valve 5.

Figure 2:
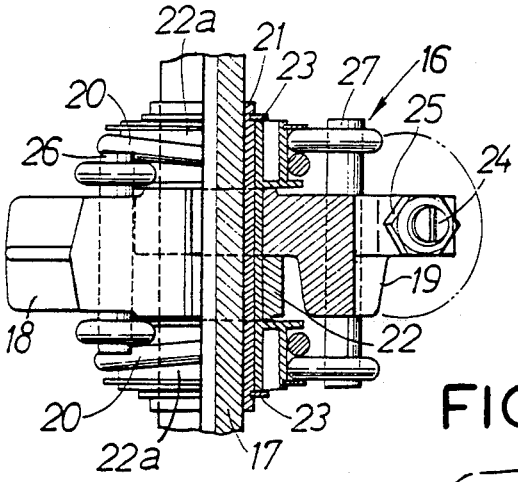

Referring to FIG. 2, a collar 22 is mounted on the rocker shaft 17 through a cylindrical slide metal 21. The collar 22 is basically shaped into a cylindrical form, and retaining rings 23 are fitted in the slide metal 21 to abut against opposite ends of the collar 22, respectively. The collar 22 is provided at its axially opposite ends with drum portions 22*a* around which the torsion springs 20 are wound, and the first and second rocker arms 18 and 19 are rotatably supported at their base ends on a portion of the collar 22 axially closer to its central portion, i.e., between both the drum portions 22*a*.

The first rocker arm 18 is disposed to extend from the rocker shaft 17 toward the intake cam 15, and a cam surface of the intake cam 18 is in slide contact with a lower surface at a leading end of the first rocker arm 18. The second rocker arm 19 is disposed to extend from the rocker shaft 17 toward the intake valve 5 with its base portion being in slide contact with a base portion of the first rocker arm 18. A tappet screw 24 is threadedly fitted for advancing and retreating movements in a leading end of the second rocker arm 19 to abut against the upper end of the valve stem 5*a* of the intake valve 5. A lock nut 25 abuting against an upper surface at the leading end of the second rocker arm 19 is threadedly fitted over the tappet screw 24 to maintain an adjusted advance or re treat position.

Locking pins 26 and 27 parallel to the rocker shaft 17 are secured to the first and second rocker arms 18 and 19 to project oppositely sideways, respectively. One end of each of the torsion springs 20 is wound around the corresponding drum portions 22*a* of the collar 22 and is engaged with the locking pin 26 of the first rocker arm 18, and the other end is engaged with the locking pin 27 of the second rocker arm 19. This allows the first and second rocker arms 18 and 19 to be biased, so that the first rocker arm 18 is swung toward the intake cam 15, and the second rocker arm 19 is swung toward the intake valve 8. Moreover, the repulsive forces of the torsion springs 20 are set to be larger than those of the valve springs 11 and 12. Thus, if the valve-operating cam shaft 14 is rotated, the intake cam 15 thereof urges the intake valve 5 downwardly through the valve driving means 16, causing the intake valve 5 to slide in the opening direction, i.e., downwardly.

Figure 3:
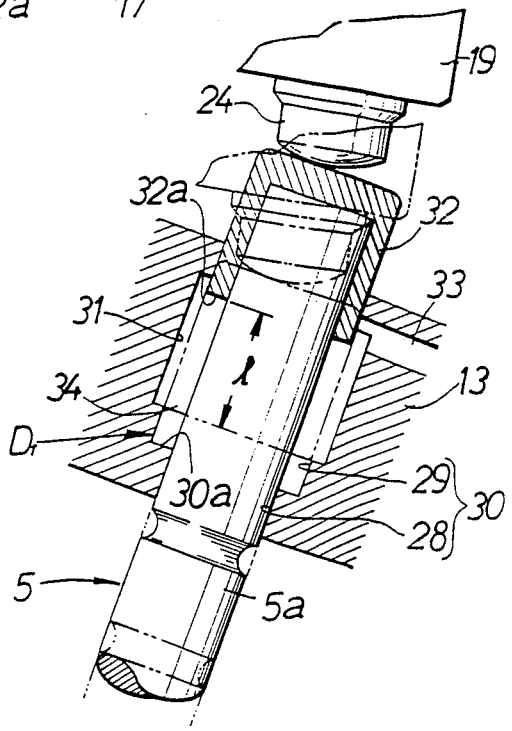

Referring also to FIG. 3, the annular electromagnet 13 is secured to the cylinder head 1 in an opposed relation to an upper surface of the spring retainer 9 to surround the valve stem 5*a* of the intake valve 5 and constructs the electromagnetic actuator A1 by cooperation with the magnetic element 9 serving as the spring retainer. The electromagnet 13 is perforated with a through hole 30 which comprises a smaller diameter hole portion 28 whose wall is in sliding contact with the valve stem 5*a* of the intake valve 5 and which is coaxially connected to a larger diameter hole portion 29 larger in diameter than the smaller diameter hole portion 28. The valve stem 5*a* of the intake valve 5 is inserted through the hole 30 for movement in an axial direction.

Excitation of a solenoid in the electromagnet 13 causes the magnetic element 9 to be attracted to the electromagnet 13. The attractive force of the electromagnetic actuator A1 and the spring forces of the valve springs 11 and 12 are set to be larger than the repulsive forces of the torsion springs 20 of the valve driving means 16. Thus, during excitation of the electromagnet 13, the intake valve 5 is maintained at its closed position regardless of the rotation of the valve-operating cam shaft 14, and the valve opening force provided by the intake cam 15 at this time is accumulated by the torsion springs 20.

A damper mechanism D1 for moderating the sudden valve-opening operation of the intake valve 5 is provided between the intake valve 5 and the electromagnet 13 as a guide member for guiding the operation of the intake valve 5. The damper mechanism D1 comprises a hydraulic chamber 34 in hole 30 around valve stem 5*a* between a stepped portion 32*a* provided at the upper end of the intake valve 5 and the electromagnet 13. More specifically, a cap-like valve piece 32 is fitted over the upper end of the valve stem 5*a* inserted through the hole 30 and is slidably received into the larger diameter hole portion 29 of the through hole 30. The hydraulic chamber 34 is defined between the stepped portion 32*a* provided by the cap-like valve piece 32 and a stepped portion 30*a* formed between the smaller diameter hole portion 28 and the larger diameter hole portion 29. An annular recess 31 is provided on an inner surface at an intermediate portion of the larger diameter hole portion 29 in the through hole 30, and the electromagnet 13 is provided with an oil feed hole 33 leading to the annular recess 31 and connected to an oil supply source which is not shown. Moreover, between an outer surface of the valve stem 5*a* and an inner surface of the smaller diameter hole portion 29, there is clearance enough to permit leakage of the hydraulic pressure within the hydraulic chamber 34 when the hydraulic pressure within the hydraulic chamber 34 is increased. Further, the valve piece 32 is fitted over the valve stem 5*a* in such a manner that an upper portion of the valve piece 32 projects upwardly from an upper end of the through hole 30 when the intake valve 5 is in its closed position, and the tappet screw 24 abuts against the valve piece 32.

Figure 4:
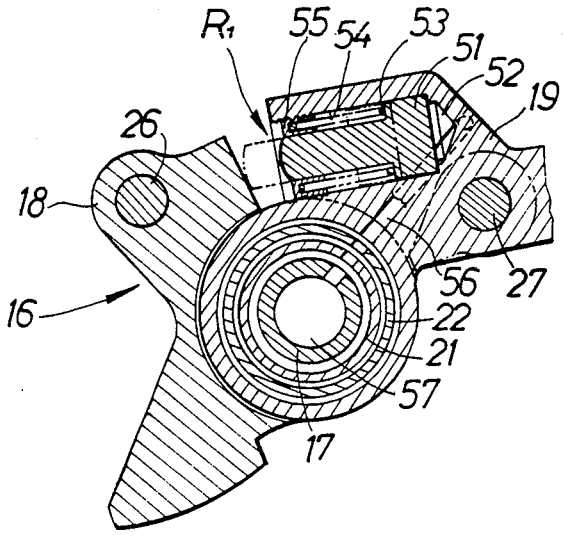

Referring to FIG. 4, a lock mechanism R1 is provided between the first and second rocker arms 18 and 19 in the valve driving means 16. The lock mechanism R1 is capable of blocking the relative swinging movement of the rocker arms 18 and 19 against the spring forces of the torsion springs 20 and comprises a locking member 51 slidably fitted in the second rocker arm 19, a hydraulic chamber 52 provided in the second rocker arm 19 to face the back of the locking member 51 in order to exhibit a hydraulic pressure for bringing the locking member 51 into abutment against the first rocker arm 18, and a return spring 53 for biasing the locking member 51 in a direction to contract the hydraulic chamber 52.

The second rocker arm 19 is provided with a bottomed slide hole 54 opened to the first rocker arm 18, and a double cylinder-like spring receiving member 55 is fitted in an opened end of the slide hole 54. The locking member 51 slidably received in the slide hole 54 can be guided by the spring receiving member 85 to project from the second rocker arm 19 in a direction to abut against the first rocker arm 18. The return spring 53 is compressed between the spring receiving member 55 and the locking member 51. Further, the hydraulic chamber 52 is defined between the locking member 51 and a closed end of the slide hole 54 and communicates with a passage 56 made in the second rocker arm 19. The passage 56 is normally in communication with a hydraulic pressure supply passage 57 provided in the rocker shaft 17 through the collar 22 and the slide metal 21, and the hydraulic pressure supply passage 57 is connected to a hydraulic pressure supply source which is not shown.

With such lock mechanism R1, if a hydraulic pressure is supplied into the hydraulic chamber 52, the locking member 51 is allowed to project toward the first rocker arm 18 against the spring force of the return spring 53 until the leading end of the locking member 61 abuts against the first rocker arm 18, whereby the relative swinging movement of the rocker arms 18 and 19 against the spring forces of the torsion springs 20 is blocked.

A control circuit C is connected to the solenoid of the electromagnet 13 and adapted to operate and sense the operative conditions of the engine, so that energization and deenergization of the electromagnet 13 are controlled in change-over by a signal from the control circuit C. Detection signals are applied to the control circuit C, such as the number of revolutions of engine, the temperature, the degree of opening of a throttle and the amount of air drawn as signals for detecting the operative conditions of the engine.

The operation of the first embodiment will be described below with reference to Figs. 5, 6 and 7. When the valve-operating cam shaft 14 is driven for rotation by operation of the engine, the intake valve 5 is driven to be opened and closed with a predetermined timing by coaction of the intake cam 15 and the valve springs 11 and 12. The amount of lift of the intake valve 5 opened relative to the angle of rotation of the valve-operating cam shaft 14 describes a lift curve as indicated by a one dot chain line in FIG. 5.

Now, when the engine is in a particular operative condition, for example, in a lower load operative condition, the electromagnet 13 is energized under a control by the control circuit, so that the magnetic element 9 is attracted to the electromagnet 13, while a circular base portion of the intake cam 15 is in slide contact with the first rocker arm 18, i.e., before the intake valve 5 is in a lifted state.

Then, when an upper portion of the intake cam 15 is brought into slide contact with the first rocker arm 18 as a result of rotation of the intake cam 15, the first rocker arm 18 is turned in a clockwise direction as viewed in FIG. 1, and the turning force thereof is transmitted via the torsion springs 20, so that a clockwise urging force as viewed in FIG. 1 also acts on the second rocker arm 19. However, the rocking movement of the second rocker arm 19 is inhibited, and as shown in FIG. 6, only the first rocker arm 18 is swung while twisting the torsion springs 20, because the attractive force of the electromagnetic actuator A1 and the spring forces of the valve springs 11 and 12 are larger than the repulsive force s of the torsion springs 20, as described above. This allows the intake valve 5 to be maintained at its closed position, and the valve-opening force provided by the intake cam 15 is accumulated by the torsion springs 20.

Figure 5:
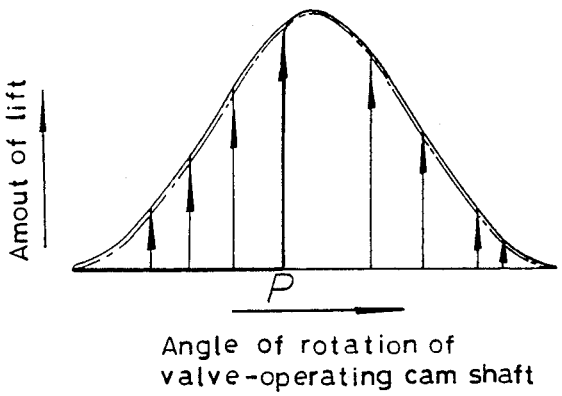

If the electromagnet 13 is deenergized under a control by the control circuit C when the valve operating cam shaft 14 continues to rotate, so that the angle of rotation reaches, for example, near a point P in FIG. 5, i.e., a point just short of the amount of lift provided by the intake cam 15 becoming a maximum, the force of attraction by the magnetic element 9 is released. This releases the valve-opening force accumulated by the torsion springs 20, so that the intake valve 5 is suddenly opened by the repulsive forces of the torsion springs 20, as shown in FIG. 7 and thus, the amount of lift of the intake valve B increases rectilinearly as indicated by a bold solid line in FIG. 5. This causes a fuel-air mixture flowing through the intake system to flow into the combustion chamber 2 at a stretch.

Figure 6:
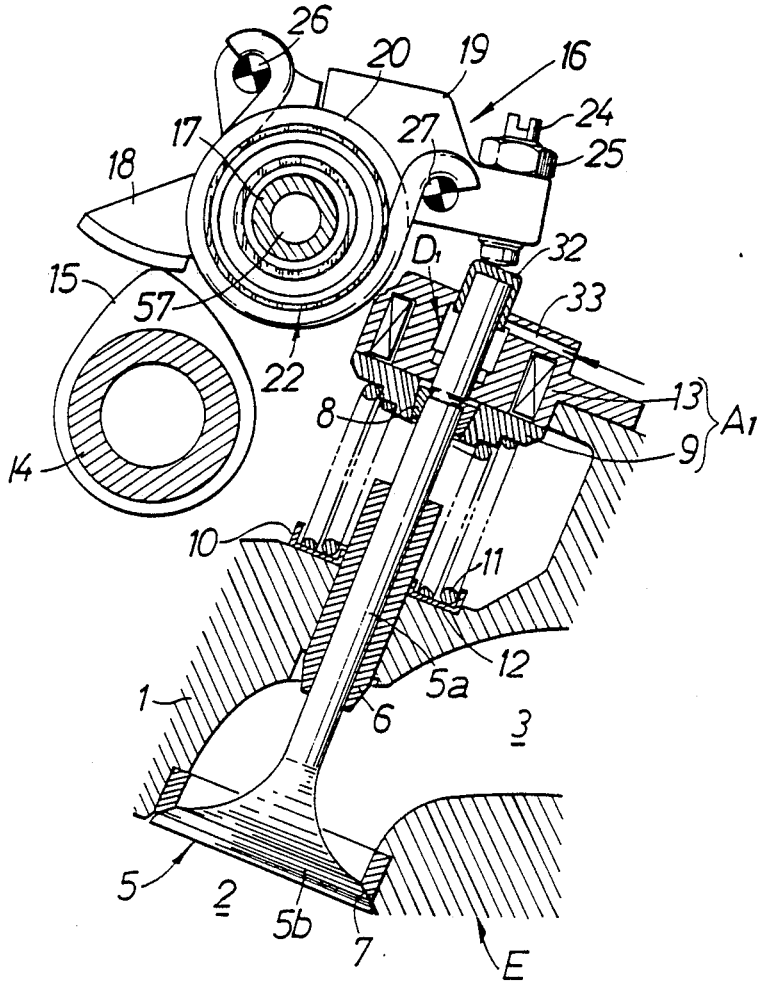
Figure 7:
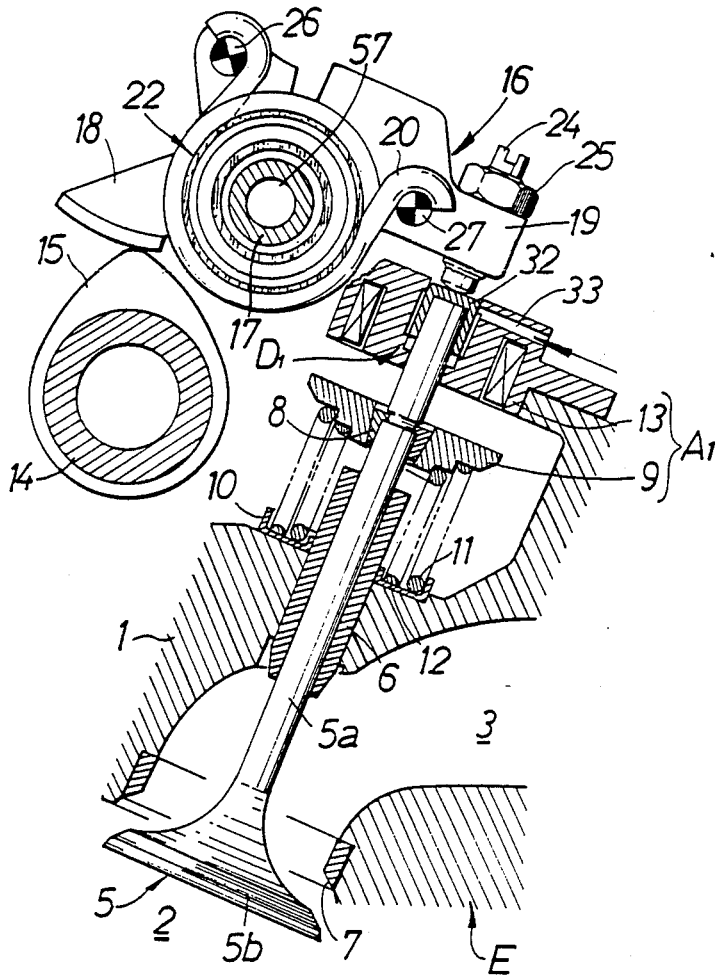

Now, if the internal combustion engine is in an intake stroke where the piston moves down and the intake valve 5 is closed as shown in FIG. 6, the interior of the combustion chamber 2 is under a far higher negative pressure as compared with the prior art due to the downward movement of the piston. When the intake valve 5 is opened quickly in this condition, as shown in FIG. 7, the intake gas flowing through the intake system into the combustion chamber 2 is supercharged, so that an increased amount of the intake gas is supplied into the combustion chamber 2, thereby achieving a supercharging effect in a lower load operational condition to provide an improvement in power.

Upon releasing of the state retained by the electromagnetic actuator A1, the valve piece 32 in the damper mechanism Dl is moved downwardly within the through hole 30 in the electromagnet 13, and when the distance l between the stepped portions 32*a* and 30*a* (see FIG. 3) becomes zero, so that the valve piece 32 is fitted into a lower portion of the larger diameter hole portion 29, the hydraulic pressure is confined into the hydraulic chamber 34 between the stepped portions 32*a* and 30*a*. Therefore the rate the valve piece 32 moves downwardly, i.e., the rate of intake valve 5 opening is moderated, so that the intake valve 5 is slowly opened, as the confined hydraulic pressure gradually leaks from between the valve piece 32 and the smaller diameter hole portion 28. In this manner a shockingly opening operation of the intake valve 5 is moderated.

After the amount of lift has become the maximum, the intake valve 5 is opened in a usual lift curve by coaction of the intake cam 15 and the valve springs 11 and 12.

Moreover, it is possible to reduce the inertial weight by disposing the torsion springs 20 around the rocker shaft 17 in the valve driving means 16. The valve operating cam shaft 14 is not disposed just above the intake valve 5 and hence, it is also possible to avoid the increase in entire height due to the disposition of the valve-operating cam shaft 14 at a location over the intake valve 5.

It should be noted that the valve-closure retaining operation of the electromagnetic actuator A1 can be effected with any timing as indicated by a thin line in FIG. 5 irrespective of the operating conditions of the engine. Specifically, the valve-opening timing can be varied at any point between from a point just after start of lifting of the cam to a point of the maximum lift as well as between from the point of the maximum lift to a point just before completion of lifting of the cam. In addition, if the energization of the electromagnetic actuator A1 is normally interrupted, there are obtained opening and closing timings generally in alignment with the cam profile. On the other hand, if the energization of the electromagnetic actuator A1 is continued during lifting of the cam, it is possible to provide the inoperative state of the valve.

When the engine has a higher load operating condition, the electromagnetic actuator A1 is deenergized, and a hydraulic pressure is supplied into the hydraulic chamber 52 in the lock mechanism R1. By doing so, the locking member 51 abuts against the first rocker arm 18, thereby blocking the relative swinging movements of the rocker arms 18 and 19 normally resisted only by the repulsive forces of the torsion springs 20. Accordingly, even though the torsion springs 20 are interposed in the valve driving means 16, it is possible to permit the second rocker arm 19 to follow the first rocker arm 18 directly, while inhibiting the resilient operation of the torsion springs 20, and thus, the intake valve 5 can be driven to be opened and closed without change of the profile of the intake cam 15.

Figure 8:
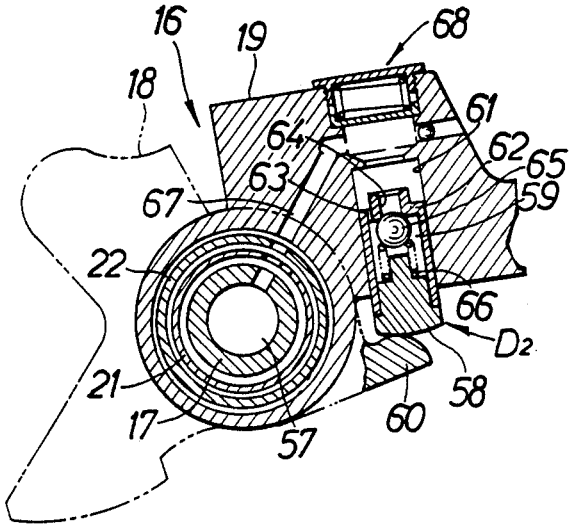
FIG. 8 is a longitudinal sectional view of an essential portion of a damper mechanism according to a second embodiment of the present invention.

FIG. 8 illustrates a second embodiment wherein a damper mechanism D2 is provided between the first and second rocker arms 18 and 19 in the valve driving means 16. The damper mechanism D2 comprises a piston 58 slidably received in the second rocker arm 19, and a hydraulic chamber 59 defined to face the back of the piston 58 in order to exhibit a hydraulic pressure for forcing the piston 58 into abutment against the first rocker arm 18.

The first rocker arm 18 is provided with an abutment arm 60 projecting therefrom and adapted to be close to the second rocker arm 19 when the both rocker arms 18 and 19 are swung by the repulsive forces of the torsion springs 20 (see FIG. 1), and the second rocker arm 19 is provided with a slide hole 61 opened in an opposed relation to the abutment arm 60. A bottomed cylindrical slide member 62 is received in the slide hole 61, and the piston 58 is received in the slide member 62 for sliding movement relative to each other. The hydraulic chamber 59 is defined between the piston 58 and the slide member 62 and communicates with the interior of the slide hole 61 through a restriction orifice 63 provided at a closed end of the slide member 62. A valve bore 64 is also made in the closed end of the slide member 62 in parallel to the restriction orifice 63. Contained in the hydraulic chamber 59 are a valve ball 65 capable of opening and closing the valve bore 64, and a spring 66 for biasing the valve ball 65 to close the valve bore.

The second rocker arm 19 is provided with a passage 67 communicating with the slide hole 61 and also normally communicating with a hydraulic pressure supply passage 57 provided in the rocker arm 17 through the collar 22 and the slide metal 21. An accumulator 68 is disposed in the second rocker arm 19 to face the passage 67.

With such damper mechanism D2, when the abutment arm 60 moves toward the second rocker arm 19, the piston 58 is driven in a direction to reduce the volume of the hydraulic chamber 59, so that the hydraulic pressure within the hydraulic chamber 59 increases and is discharged out of the hydraulic chamber 59 through the restriction orifice 63.

Thus, when the valve 5 is closed, as shown in FIG. 6, and the actuator A1 is released, the damper mechanism D2 dampens the clockwise movement of rocker arm 19 by springs 20 to open the valve 5.

The operation of the second embodiment will be described below. When the retaining by the electromagnetic actuator A1 (see FIG. 1) is released, the rate of intake valve 5 opening is moderated by the damper mechanism D2. More specifically, in the damper mechanism D2, as the hydraulic pressure within the hydraulic chamber 59 is gradually discharged through the restriction orifice 63, the second rocker arm 19 is swung in a valve-opening direction, thereby moderating the action of the second rocker arm 19 in the valve opening direction.

Moreover, if the damper mechanism D2 is combined with the damper mechanism D1 of the previous first embodiment, the total effect of buffering the rate of valve opening is more effective. In the damper mechanism D1, a buffering effect is exhibited from the time when the distance between the stepped portions 32*a* and 30*a* has become zero as shown in FIG. 3. This is in the situation where the energy released from the torsion springs 20 is larger in the vicinity of a position in which the amount of lift of the intake valve 5 becomes the maximum. On the other hand, in the damper mechanism D2, a buffering effect is being exhibited all the time while the intake valve 5 is in operation of opening the valve. Thus, it is possible for the both damper mechanisms D1 and D2 to compensate for the mutual buffering effects to effectively achieve the shock damping for the intake valve 5.

Figure 9:
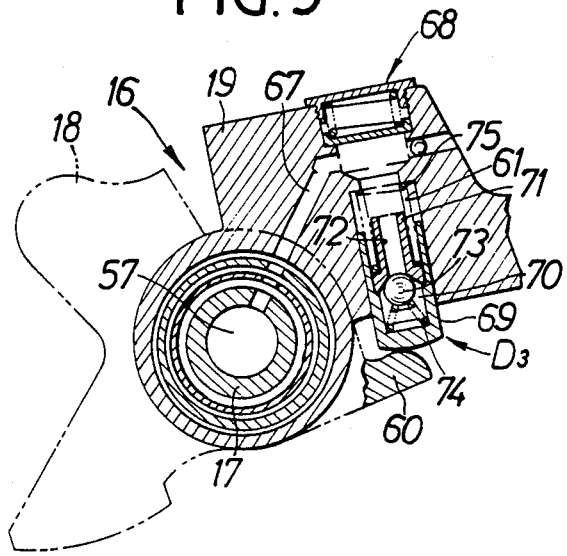
FIG. 9 is a longitudinal sectional view of an essential portion of a damper mechanism according to a third embodiment of the present invention.

FIG. 9 illustrates a third embodiment of the present invention, wherein a damper mechanism D3 is provided at an impulse contact portion between the first and second rocker arms 18 and 19.

The damper mechanism D3 comprises a piston 69 slidably received in the second rocker arm 19, and a hydraulic chamber 70 defined to face a back of the piston 69 in order to exhibit a hydraulic pressure for forcing the piston 69 into abutment against the first rocker arm 18.

The second rocker arm 19 is provided with a slide hole 61 opened in an opposed relation to an abutment arm 60 of the first rocker arm 18. The bottomed cylindrical piston 69 is slidably received in the slide hole 61, and a cylindrical slide member 71 is received in the piston 69 for sliding movement relative to each other. The hydraulic chamber 70 is defined between the piston 69 and the slide member 71 and communicates with the interior of the slide hole 61 through a clearance provided between the piston 69 and the slide member 71. A valve bore 72 is also made in the slide member 71. The hydraulic chamber 70 contains therein a valve ball 73 capable of opening and closing the valve bore 72 and a spring 74 for biasing the valve ball 73 to close the valve bore. Further, the slide member 71 is biased in a direction to fit into the piston 69 by a spring 75 interposed between the slide member 71 and the second rocker arm 19.

As in the above-described second embodiment, the slide hole 61 normally communicates with the hydraulic pressure supply passage 57 in the rocker shaft 17 through the passage 67, and an accumulator 68 is disposed on the way of the passage 67.

With such damper mechanism D3, when the abutment arm 60 moves toward the second rocker arm 19, the piston 69 is driven in a direction to reduce the volume of the hydraulic chamber 70, so that the hydraulic pressure within the hydraulic chamber 70 increases and is discharged from the clearance between the piston 69 and the slide member 71 into the slide hole 61. In this way, it is possible to achieve a buffering effect similar to that of the damper mechanism D2 in the previously-described second embodiment.

Figure 10:
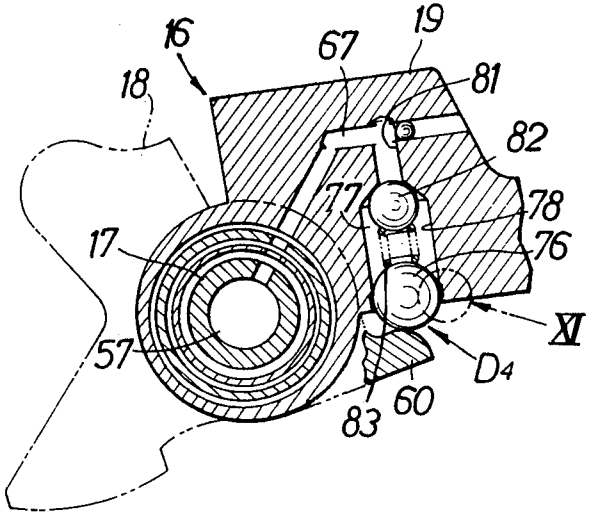
FIGS. 10 and 11 illustrate a fourth embodiment of the present invention, FIG. 10 being a longitudinal sectional view of an essential portion of a damper mechanism, and FIG. 11 being an enlarged sectional view of a portion of FIG. 10 at the circle XI FIG. 10.
Figure 11:
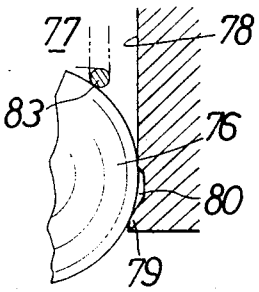

FIGS. 10 and 11 illustrate a fourth embodiment of the present invention, wherein a damper mechanism D4 is provided at an impulse contact portion between the first and second rocker arms 18 and 19.

The damper mechanism D4 comprises a ball 76 rollably received in the second rocker arm 19 and a hydraulic chamber 77 defined to face a back of the ball 76. The ball 76 is biased in a direction to abut against the abutment arm 60 of the first rocker arm 18, by an action of a hydraulic pressure in the hydraulic chamber 77.

The second rocker arm 19 is provided with a slide hole 78 in which the ball 76 is received. Moreover, an opened end of the slide hole 78 is provided over its entire periphery with a restricting jaw 79 for inhibiting the ball 76 from falling out of the slide hole 78, and inwardly of the restricting jaw 79, there is a recess providing an annular clearance 80 between a wall of the recess and the ball 76. Further, the second rocker arm 19 is provided with a valve bore 81 connecting the passage 67 provided in the second rocker arm 19 and the hydraulic chamber 77. Contained in the hydraulic chamber 77 are a valve ball 82 capable of opening and closing the valve bore 81 and a spring 83 for biasing the valve ball 82 to close the valve bore.

With the damper mechanism D4, when the ball 76 has been forced into the slide hole 78 by the abutment arm 60, the hydraulic pressure within the hydraulic chamber 77 leaks through the clearance 80. The rate of ball 76 movement is determined depending upon the amount of such leakage and hence, the rate the second rocker arm 19 is swung during opening of the valve is moderated.

Figure 12:
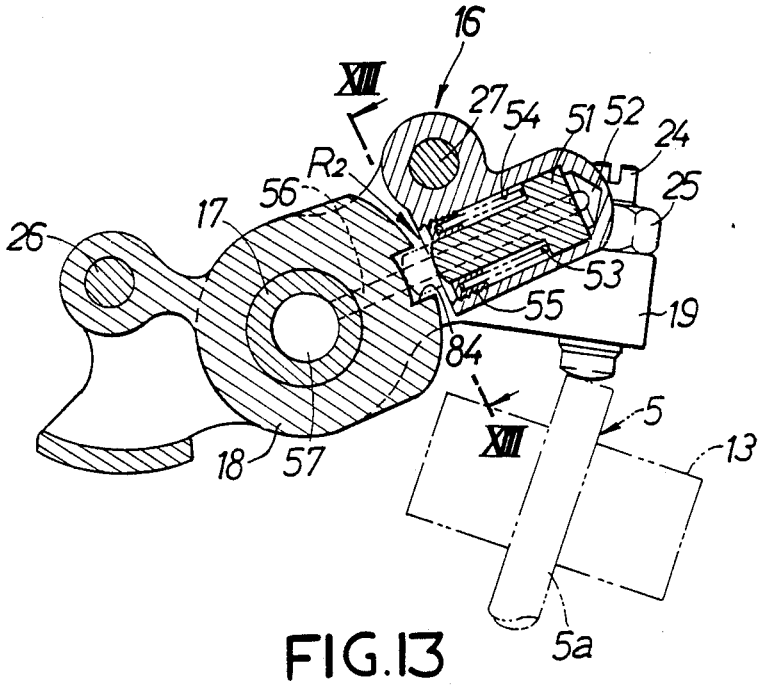
FIGS. 12 and 13 illustrate a fifth embodiment of the present invention, FIG. 12 being a longitudinal sectional side view of a lock mechanism, and FIG. 13 being a view taken along the line XIII—XIII in FIG. 12.
Figure 13:
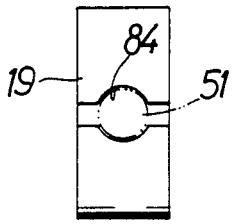
Figure 14:
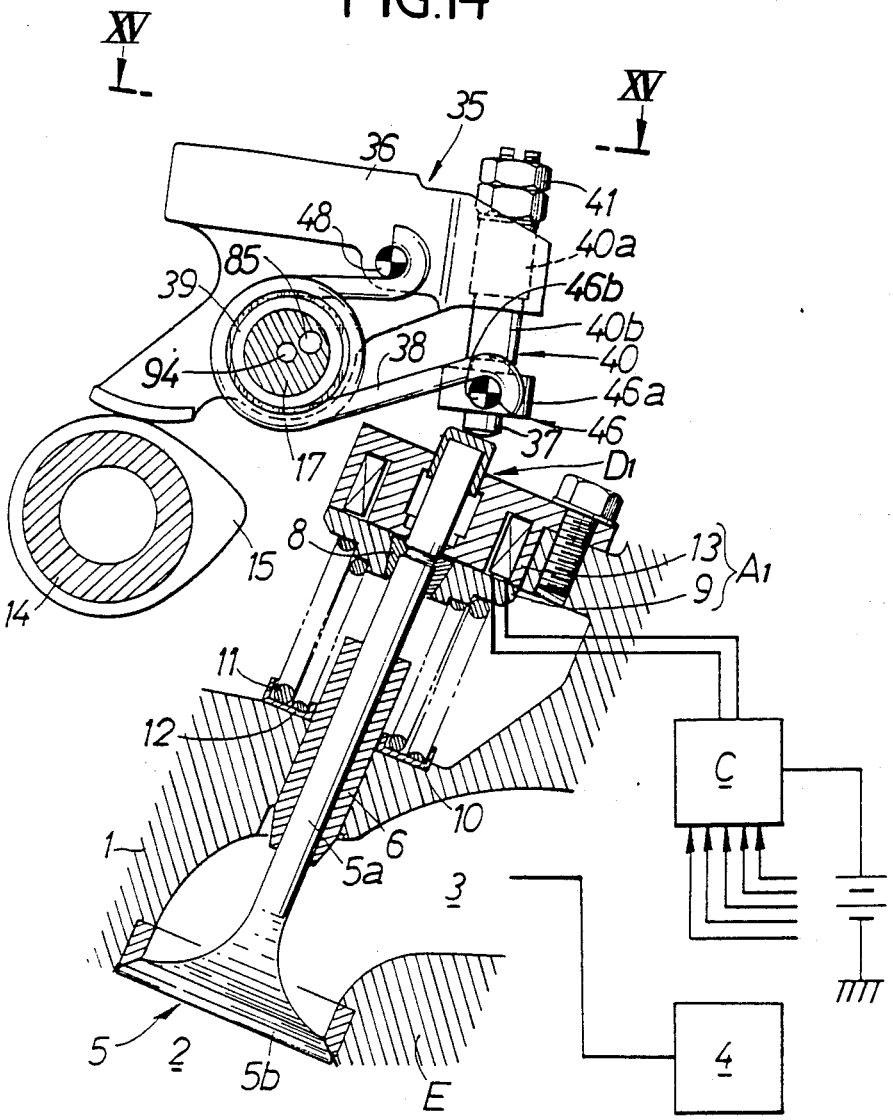
Figure 15:
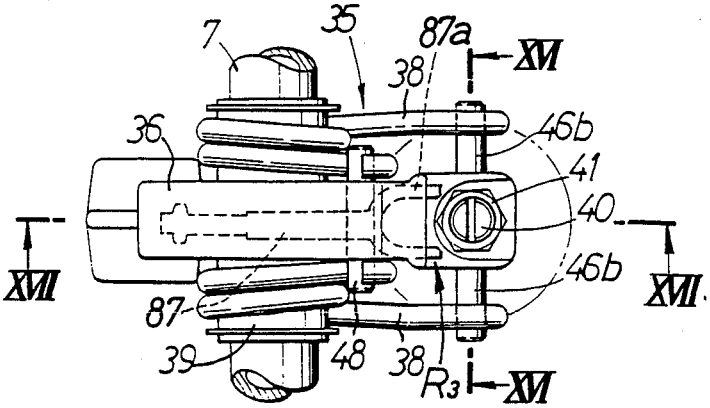
Figure 16:
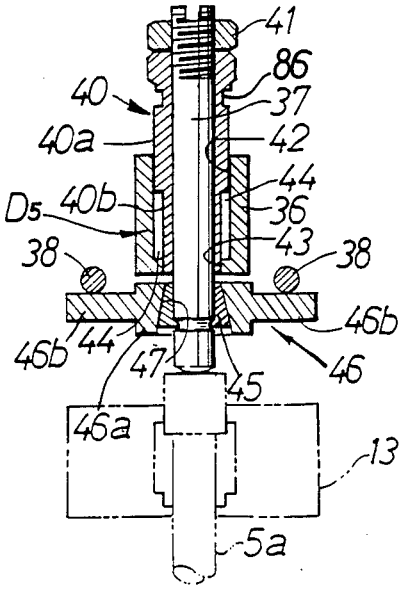
Figure 17:
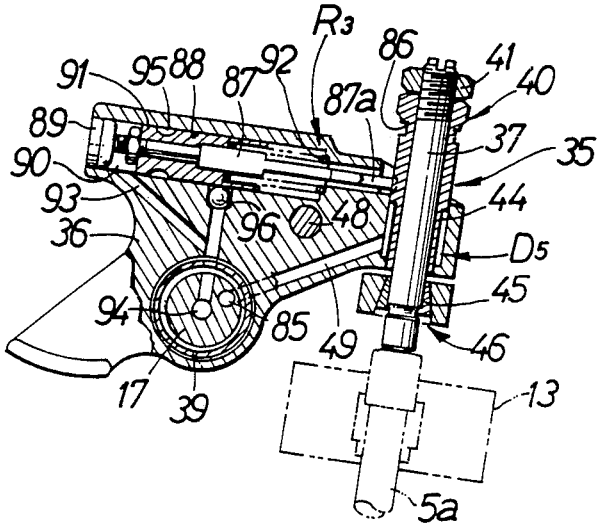

FIGS. 12 and 13 illustrate a fifth embodiment of the present invention, wherein like reference characters are used to designate portions corresponding to those in each of the previous embodiments.

A lock mechanism R2 is provided between the first and second rocker arm 18 and 19. The lock mechanism R2 comprises a locking member 51 slidably received in the second rocker arm 19, a hydraulic chamber 52 defined to face a back of the locking member 51, a re&urn spring 53 for providing a biasing force in a direction to move the locking member 51 away from the first rocker arm 18, and a fitting recess 84 provided in the first rocker arm 18 so that a leading end of the locking member 51 may be fitted thereinto.

According to the fifth embodiment, the relative swinging movement of the both rocker arms 18 and 19 is blocked by supplying a hydraulic pressure into the hydraulic chamber 52 to allow the locking member 51 to project to the first rocker arm 18 so as to fit into the recess 84. If the lock mechanism R2 is operated so, the intake valve 5 can be driven to be opened and closed in correspondence to a profile of the intake cam 15.

FIGS. 14 to 19 illustrate a sixth embodiment of the present invention, wherein portions corresponding to those in each of the previous embodiment are denoted by like reference characters.

Valve driving means 35 is interposed between the intake valve 5 and the intake cam 15 and comprises a rocker arm 36 pivotally carried on the rocker shaft 17 for swinging movement in sliding contact with the intake cam 15, a sliding plunger 37 carried on the rocker arm 36 for sliding movement in abutment against the upper end of the valve stem 5*a* of the intake valve 5, and torsion springs 38 as valve-opening resilient members interposed between the rocker arm 36 and the sliding plunger 37.

The rocker arm 36 is carried on the rocker shaft 17 through a collar 39. A basically cylindrical stopper 40 is fitted over the sliding plunger 37 so that the axial position thereof relative to the sliding plunger 37 may be variable, such as by a threaded connection. The stopper 40 is slidably fitted in the rocker arm 36 to define a lowermost limit position of the sliding plunger 37 relative to the rocker arm 36. A lock nut 41 is also fitted over the sliding plunge r 37 for locking the position of the stopper 40. The rocker arm 36 is provided with a hole comprising a larger diameter hole portion 42 and a smaller diameter hole portion 43 which are coaxially connected in sequence from the above, and the stopper 40 is provided with a larger diameter portion 40*a* slidably fitted in the larger diameter hole portion 42 and a smaller diameter portion 40*b* slidably fitted in the smaller diameter hole portion 43. Thus, the lowermost limit position of the stopper 40, i.e., of the sliding plunger 37 relative to the rocker arm 36 is defined by abutment of a stepped portion between the larger diameter portion 40*a* and the smaller diameter portion 40*b* against a stepped portion between the larger diameter hole portion 42 and the smaller diameter hole portion 43.

Furthermore, a damper mechanism D5 is provided between the rocker arm 36 and the stopper 40 fixedly mounted on the sliding plunger 37 and includes a hydraulic chamber 44 defined between the rocker arm 36 and the stopper 40. The hydraulic chamber 44 communicates with a hydraulic pressure supply passage 85 within the rocker shaft 17 through a passage 49 made in the rocker arm 36. The damper mechanism D5 performs a buffering effect during downward sliding movement of the siding plunger 37 by permitting a hydraulic pressure to leak through the clearance between the stopper 40 and the rocker arm 36. A damper mechanism D1 is also provided between the valve stem 5*a* of the intake valve 5 and the electromagnet 13.

An arm member 46 is fixedly mounted on a lower portion of the sliding plunger 37 through a cotter 45. The arm member 46 is comprised of a disk portion 46*a* and pin-like locking portions 46*b* provided on the disk portion 46*a* to project therefrom along one diametrical line of the disk portion 46*a*. The arm member 46 is fixed on the sliding plunger 37 by press-fitting the cotter 45 into a wedge which is centrally made in the disk portion 46*a* to gradually decrease in diameter upwardly.

The torsion springs 38 are engaged at one ends thereof with a locking pin 48 fixed on the rocker arm 36 to project oppositely sideways in parallel to the rocker shaft 17, and at the other ends thereof with locking portions 46*b* of the arm member 46, respectively. The torsion springs 38 exhibit repulsive forces in a direction to allow the rocker arm 36 to slide on the intake cam 15 and in a direction to bring the sliding plunger 37 into abutment against the intake valve 5.

A lock mechanism R3 is provided between the rocker arm 36 and the sliding plunger 37. The lock mechanism R3 comprises an annular locking groove 86 as locking means provided in an outer surface of the larger diameter portion 40*a* of the stopper 40 substantially integral with the sliding plunger 37, and a locking member 87 disposed in the rocker arm 36 for advancing and retreating movements and having at its leading end a substantially U-shaped engage claw 87*a* capable of engaging the locking groove 86.

The rocker arm 36 is provided with a slide hole 88 having an axis perpendicular to an axis of the sliding plunger 37, with an end of the slide hole 88 opposite from the sliding plunger 37 being closed by a cap 89. An operating piston 91 is slidably received in the slide hole 88 and defines a hydraulic chamber 90 between the cap 89, and a base end of the locking member 87, which is inserted in the slide hole 88 with the engage claw 87*a* at its leading end being projectable from an opened end of the slide hole 88 closer to the sliding plunger 37, is secured to the operating piston 91. A return spring 92 is interposed between the operating piston 91 and the rocker arm 36 to surround the locking member 87 within the slide hole 88 for biasing the operating piston 91 and thus the locking member 87 in a direction to reduce the volume of the hydraulic chamber 90.

The rocker arm 36 is also provided with a passage 93 communicating with the hydraulic chamber 90. The passage 93 is normally in communication With a hydraulic pressure supply passage 94 made in the rocker shaft 17 independently of the above-described hydraulic pressure supply passage 85. Moreover, the hydraulic pressure supply passage 94 is connected to a hydraulic pressure supply source which is not shown, so that the operating piston 91 may be operated in a direction to allow the engage claw 87*a* at the leading end of the locking member 87 to project from the slide hole 88, by supplying hydraulic pressure from the hydraulic supply source into the hydraulic chamber 90.

Additionally, an annular groove 95 is provided in an outer surface at a middle portion of the operating piston 91, and an engage sphere 96 is disposed to face an intermediate portion of the slide hole 88 and is engageable in the annular groove 95 in a condition where the piston 91 has been moved to a position to permit the engage claw 87*a* at the leading end of the locking member 87 to project from the slide hole 88. In other words, the engage sphere 96 is carried in the rocker arm 36 for movement in a radial direction of the operating piston 91 between a position in which it engages the annular groove 95 and a position in which such engagement has been released. A hydraulic pressure in the passage 93 acts on a back of the engage sphere 96.

On the other hand, the locking groove 86 provided in the stopper 40 substantially integral with the sliding plunger 37 is disposed at a location where the engage claw 87*a* of the locking member 87 can be engaged in the locking groove when the sliding plunger 37 has been moved relative to the rocker arm 36 to the uppermost limit position.

As in the previous first embodiment, the electro-magnetic actuator A1 is comprised of the electromagnet 13 and the spring retainer 9.

Figure 18:
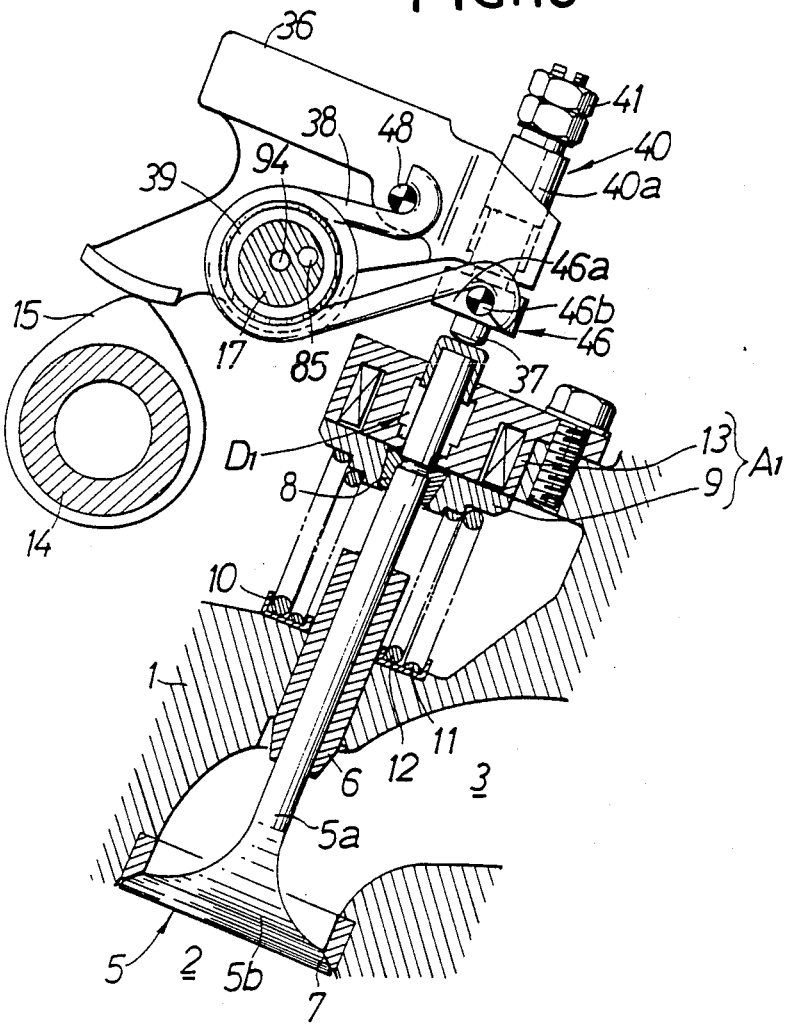
Figure 19:
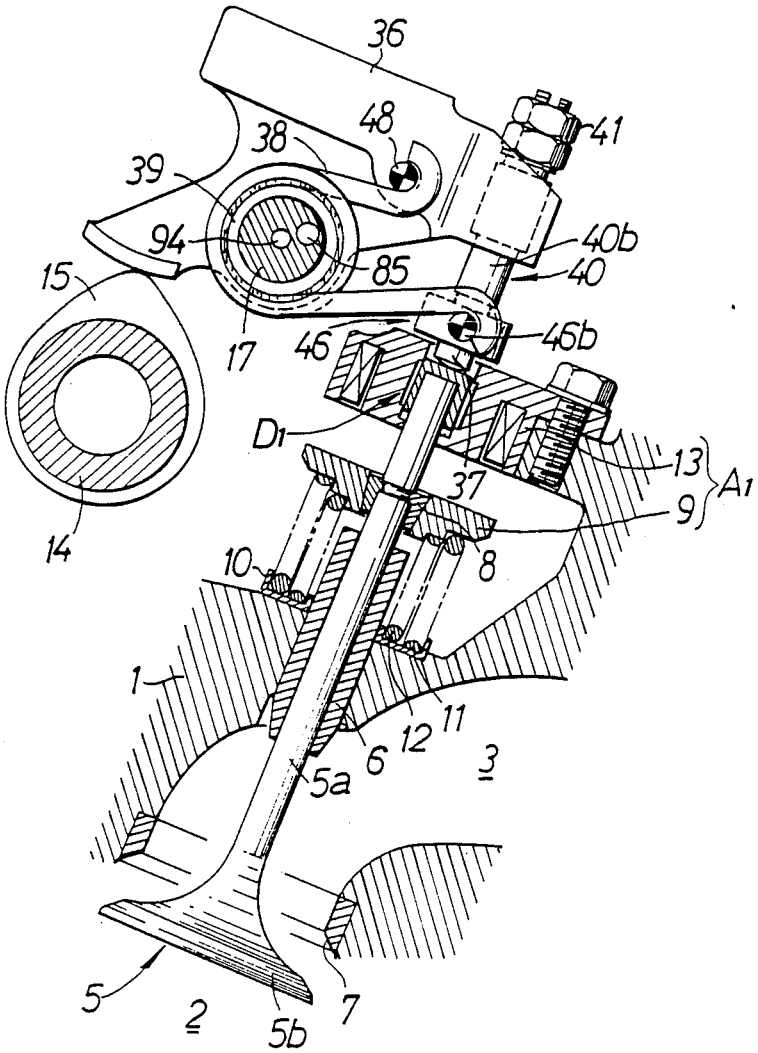

With the sixth embodiment, the energization of the electromagnet 13 of the electromagnetic actuator A1 makes it possible to retain the intake valve 5 in its closed position by upward movement of the sliding plunger 37 relative to the rocker arm 36, even with the rocker arm 36 in slide contact with a lobe portion of the intake cam 15 as shown in FIG. 18. At this time, as the retaining by the electro-magnetic actuator A1 is released, the valve opening force accumulated by the torsion springs 38 can be allowed to suddenly act on the intake valve 5 as shown in FIG. 19, thereby opening the intake valve 5 quickly, wherein the rate of valve opened can be moderated by the damper mechanisms D1 and D5.

When the engine is in a higher load operation, the supplying of a hydraulic pressure into the hydraulic chamber 90 in the lock mechanism R3 allows the engage claw 87*a* at the leading end of the locking member 87 to be engaged into the locking groove 86, and by maintaining such state by engagement of the engage sphere 96 in the annular groove 95, the rocker arm 36 can be substantially united with the sliding plunger 37, so that the intake valve 5 can be operated to be opened and closed in positive correspondence to the profile of the intake cam 15.

Moreover, in the sixth embodiment, the length of rocker arm 36 supported on the rocker shaft 17 can be relatively lengthened in order to insure a surface pressure on the rocker shaft 17. Further, the structure can be simplified, leading to a convenient in workability such as boring as well as assuring of accuracy.

Figure 20:
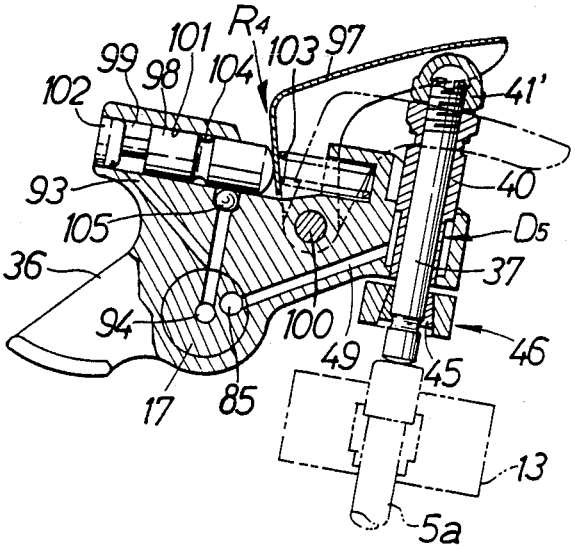
FIG. 20 is a longitudinal sectional view of an essential portion of a lock mechanism according to a seventh embodiment of the present invention.

FIG. 20 illustrates a seventh embodiment of the present invention, wherein a lock mechanism R4 is provided between the rocker arm 36 and the sliding plunger 37.

The lock mechanism R4 comprises a locking member 97 carried on the rocker arm 36 for swinging movement between a position (illustrated by a chain line in FIG. 20) in which it is engaged with a lock nut 41' threadedly attached on an upper end of the sliding plunger 37 to maintain the position of the stopper 40 and a position (illustrated by a solid line in FIG. 20) in which such engagement has been released, an operating piston 98 disposed in the rocker arm 36 for advancing and retreating movements to urge the locking member 97 toward the engaged position, and a hydraulic chamber 99 provided in the rocker arm 36 to face a back of the operating piston 98 in order to allow a hydraulic pressure to act on the operating piston 98.

The locking member 97 is formed to have a substantially U-shaped cross-section so as to engage the lock nut 41' from the above and carried at its base end on the rocker arm 36 by a stub shaft 100 having an axis extending in a direction perpendicular to an axis of the sliding plunger 37.

On the other hand, the rocker arm 36 is provided with a slide hole 101 having an axis perpendicular to an axis of the sliding plunger S7, with an end of the slide hole 101 opposite from the sliding plunger 37 being closed by a cap 102. An operating piston 98 is slidably received in the slide hole 101 and defines the hydraulic chamber 99 between the cap 102, with a leading end of the piston abutting against a back of a base end of the locking member 97. In addition, a return spring 103 is interposed between an inner surface of the base end of the locking member 97 and the rocker arm 36 for biasing the operating piston 98 in a direction of swinging movement of the locking member 97 toward the disengaged position, i.e., in a direction to reduce the volume of the hydraulic chamber 99.

The hydraulic chamber 99 is normally in communication with a hydraulic pressure supply passage 94 in the rocker shaft 17 through a passage 93 in the rocker arm 36. As in the previous sixth embodiment, an engage sphere 105 is disposed in an intermediate portion of the slide hole 101 and adapted to engage an annular groove 104 provided in an outer surface of an intermediate portion of the operating piston 98 when the locking member 97 has been swung to the engaged position.

Even with the seventh embodiment and as in the previous embodiment, the intake valve 5 can be operated to be opened and closed along the profile of the intake cam 15 with the relative operation of the rocker arm 36 and the sliding plunger 37 being blocked by the lock mechanism R4.

Figure 21:
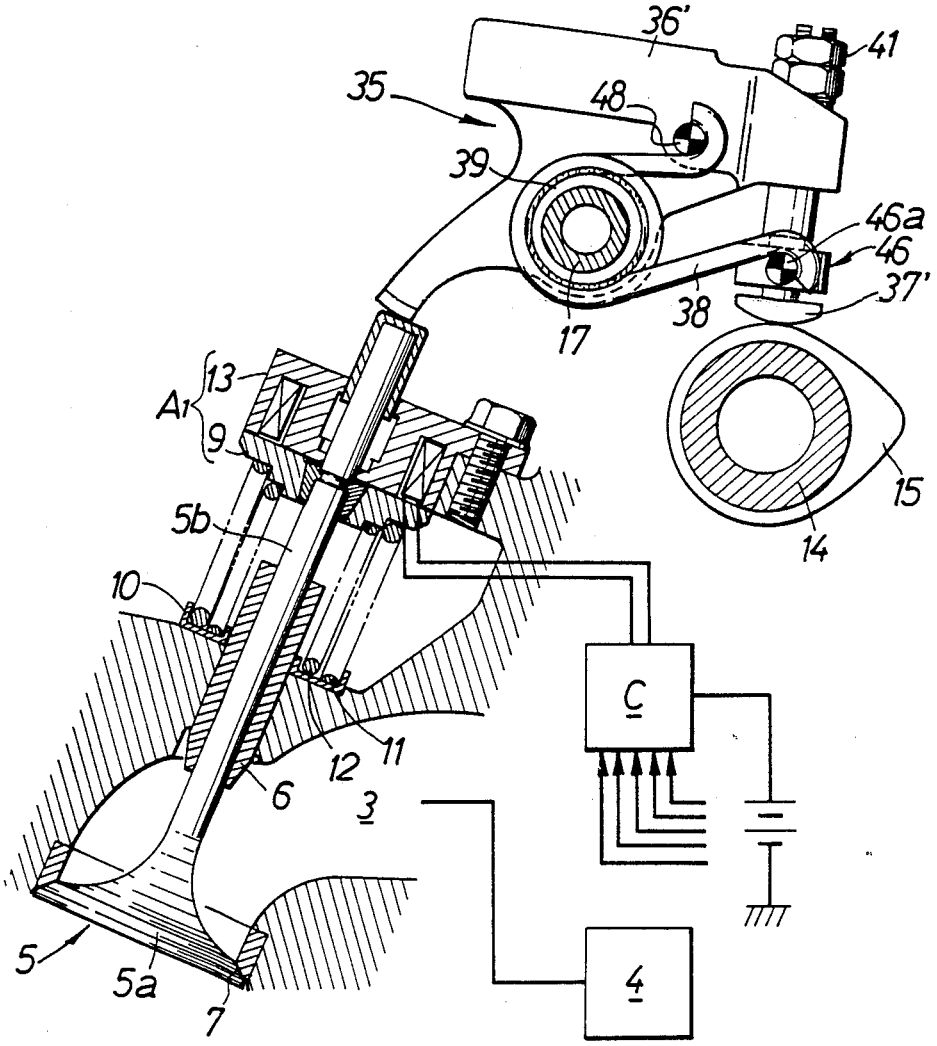
FIG. 21 is a longitudinal sectional side view of a eighth embodiment of &he present invention.
Figure 22:
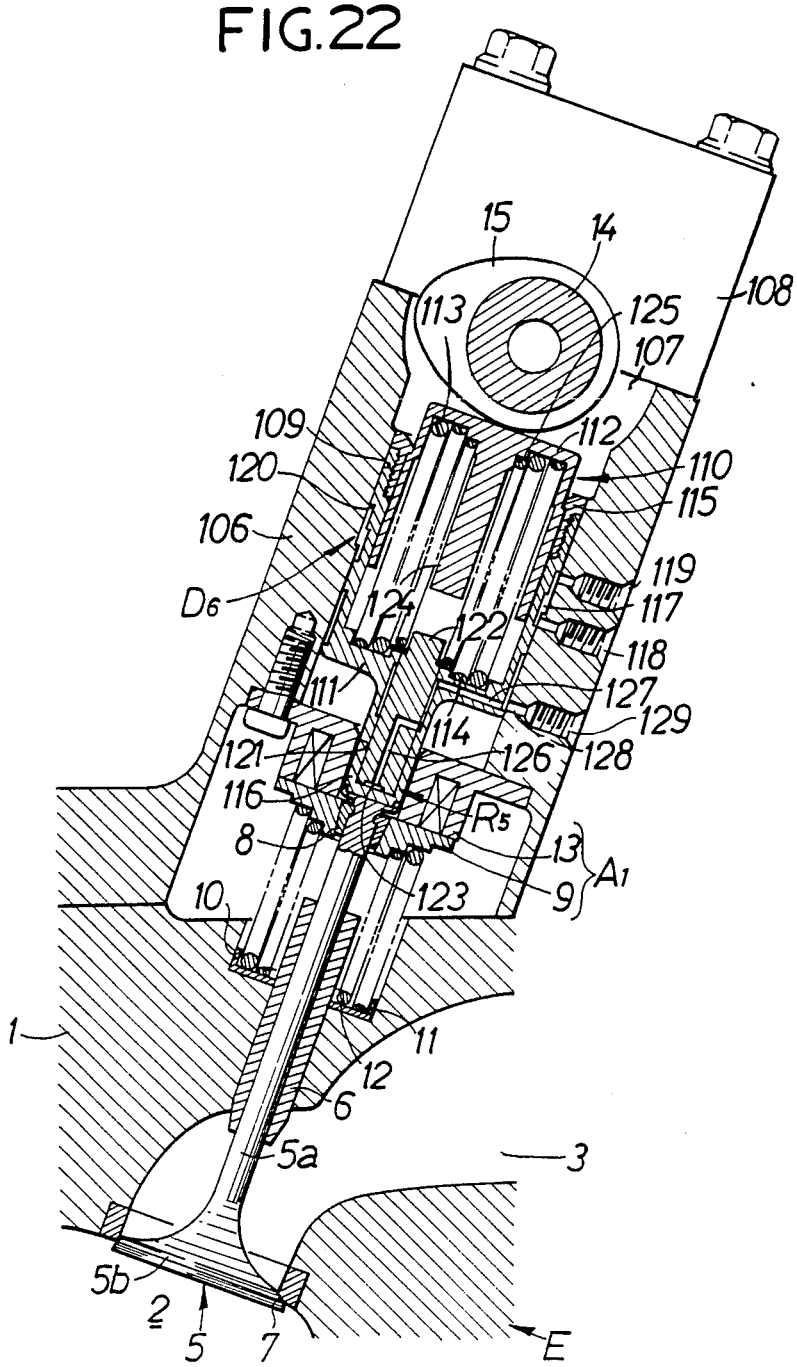

FIG. 21 illustrates an eighth embodiment of the present invention, wherein portions corresponding to those in each of the previous embodiments are designated by the same reference characters.

The eighth embodiment is similar to the sixth embodiment, but it should be noted that a rocker arm 36' abuts against the valve stem 5*a* of the intake valve 5, and a sliding plunger 37' in slidable contact with the intake cam 15 is slidably carried on the rocker arm 36'.

Even with the eighth embodiment and as in the previous embodiments, the timing of opening the intake valve 5 can be freely controlled to improve the intake or suction efficiency.

FIGS. 22 to 26 illustrate a ninth embodiment of the present invention, wherein portions corresponding to those in each of the previous embodiments are designated by the same reference characters.

A cylindrical support 106 is integrally formed on the cylinder head 1 to extend upwardly in an axial direction of the intake valve 5, and a valve operating cam shaft 14 is rotatably supported by a bearing half 107 formed on the cylindrical support and a bearing cap 108 secured to an upper surface of the bearing half 107. An intake cam 15 provided on the valve-operating cam shaft 14 is linked to the intake valve 5 through a valve lifter 110 as valve driving means.

A hollow cylinder portion 109 is formed in the cylindrical support 106 of the cylinder head 1 and connects the intake cam 15 with the intake valve 5, and the valve lifter 110 is contained in the hollow cylinder portion 109. The valve lifter 110 is comprised of a lower lifter portion 111 slidably received in a bottomed hollow cylinder formed in the hollow cylinder portion 109, a hat-like upper lifter portion 112 vertically slidably fitted in the lower lifter portion 111 from its upper opened portion, two lifter springs 113 and 114 as valve-opening resilient members provided in compression between the lower lifter portion 111 and the upper lifter portion 112 for biasing the lower and upper lifter portions to expand from each other, and a set nut 115 threadedly attached to the upper opened portion of the lower lifter portion 111 and adapted to engage the upper lifter portion 112 to define an upper limit position of the upper lifter portion 112.

A projecting pin 116 is integrally provided on the lower lifter portion 111 to project from a central portion of a lower surface of the lower lifter portion 111, with a lower end of the projecting pin 116 permitted to abut against an upper end of the valve stem 5*a* of the intake valve 8. A cam surface of the intake cam 15 is also permitted to abut against an upper surface of the upper lifter portion 112. Moreover, the repulsive forces of the lifter springs 113 and 114 are set to be larger than those of the valve springs 11 and 12. Thus, if the valve-operating cam shaft 14 is rotated, the intake cam 15 urges the intake valve 5 downwardly through the valve lifter 110 to slide in a valve-opening direction, i.e., downwardly.

An electromagnet 13 is fixedly mounted on a lower portion of the cylindrical support 106 and constitutes an electromagnetic actuator A1 in cooperation with an upper surface of the spring retainer 9. Inserted into a hollow portion of the electromagnet 13 is an abutment portion of the upper end of the valve stem 5*a* of the intake valve 5 in abutment with the projecting pin 116 integral with the lower lifter portion 111.

A damper mechanism D6 is provided between the lower lifter portion 111 and the cylindrical support 106. The damper mechanism D6 comprises an annular hydraulic chamber 117 provided between an outer peripheral surface of the lower lifter portion 111 and an inner peripheral wall of the cylindrical support 106. An oil supply port 118 and an oil discharge port 119 are made in the cylindrical support 106 to communicate with the hydraulic chamber 117, and a hydraulic circuit, for example, a lubricating-oil circuit for the engine is connected to the hydraulic chamber 117, so that a pressure oil may be circulated through the chamber 117. Thus, the pressure oil flowing into the hydraulic chamber 117 provides a buffering effect and a lubricating effect on the valve lifter 110 when it acts on a downwardly faced pressure receiving surface 120 formed on the outer peripheral surface of the lower lifter portion 111 to lift the valve lifter 110.

A lock mechanism R5 is interposed between the lower lifter portion 111 and the upper lifter portion 112 slidably fitted in the lower litter portion 111.

The lock mechanism R5 comprises a locking member 122 slidably received in a bottomed slide hole 121 centrally provided in the lower lifter portion 111, a hydraulic chamber 123 defined between the locking member 122 and a closed end of the slide hole 121, an abutting pin 124 provided at a central portion of the upper lifter portion 112 to be able to abut against an upper end of the locking member 122, and a return spring 125 interposed between the locking member 122 and the upper lifter portion 112 to exhibit a spring force in a direction to reduce the volume of the hydraulic chamber 123.

The locking member 122 is provided with an oil passage 126 communicating with the hydraulic chamber 123, and the lower lifter portion 111 is provided with an oil passage 127 which normally communicates with the oil passage 126 irrespective of the relatively moved position of the lower lifter portion 111 relative to the locking member 122. The cylindrical support 106 is provided with an oil passage 128 which normally communicates with the oil passage 127 irrespective of the upper and lower positions of the lower lifter portion 111 and which is connected through a connecting hole 129 to a hydraulic pressure supply source which is not shown.

The axial length of the abutting pin 124 is set such that it will not abut against the upper end of the locking member 122 in a condition of no hydraulic pressure supplied into the hydraulic chamber 123, even if the lower and upper lifter portions 111 and 112 are relatively moved at a maximum toward each other.

Figure 23:
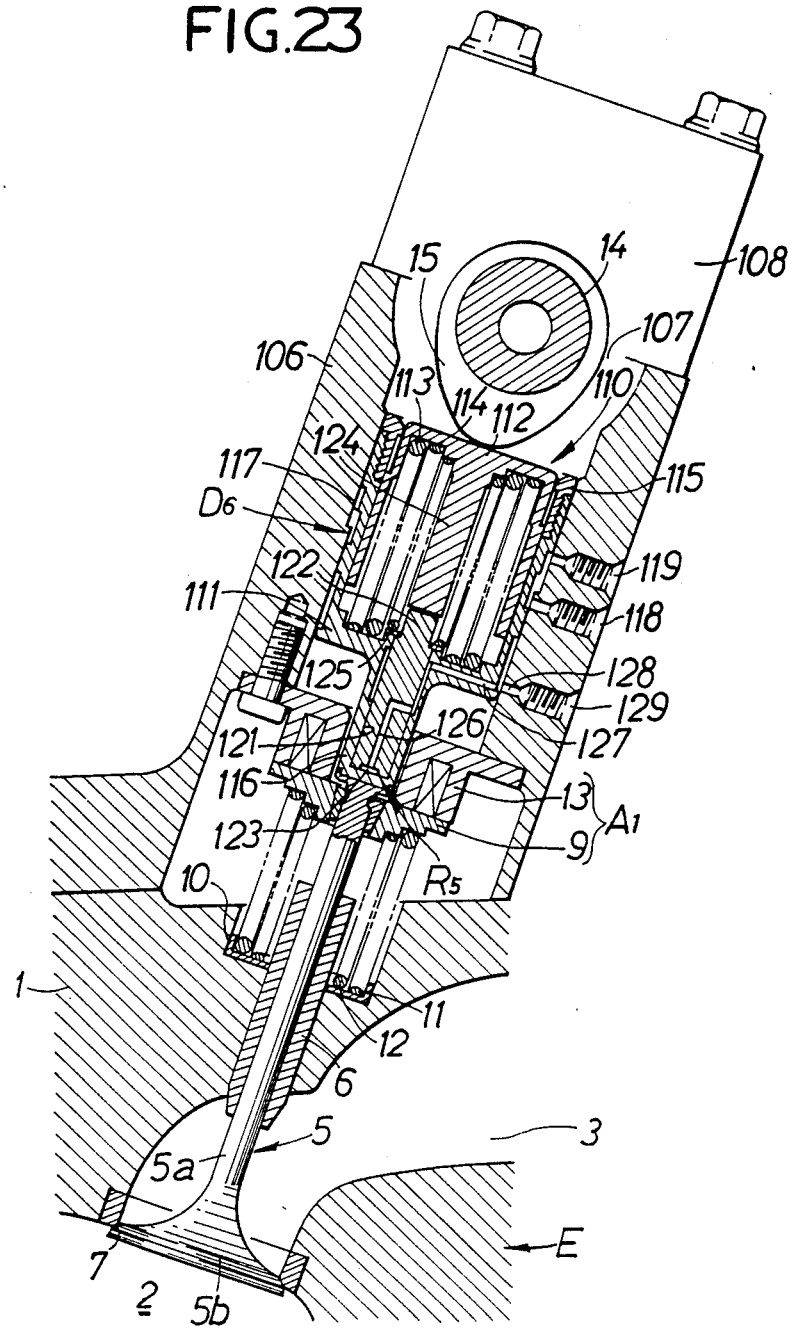
Figure 24:
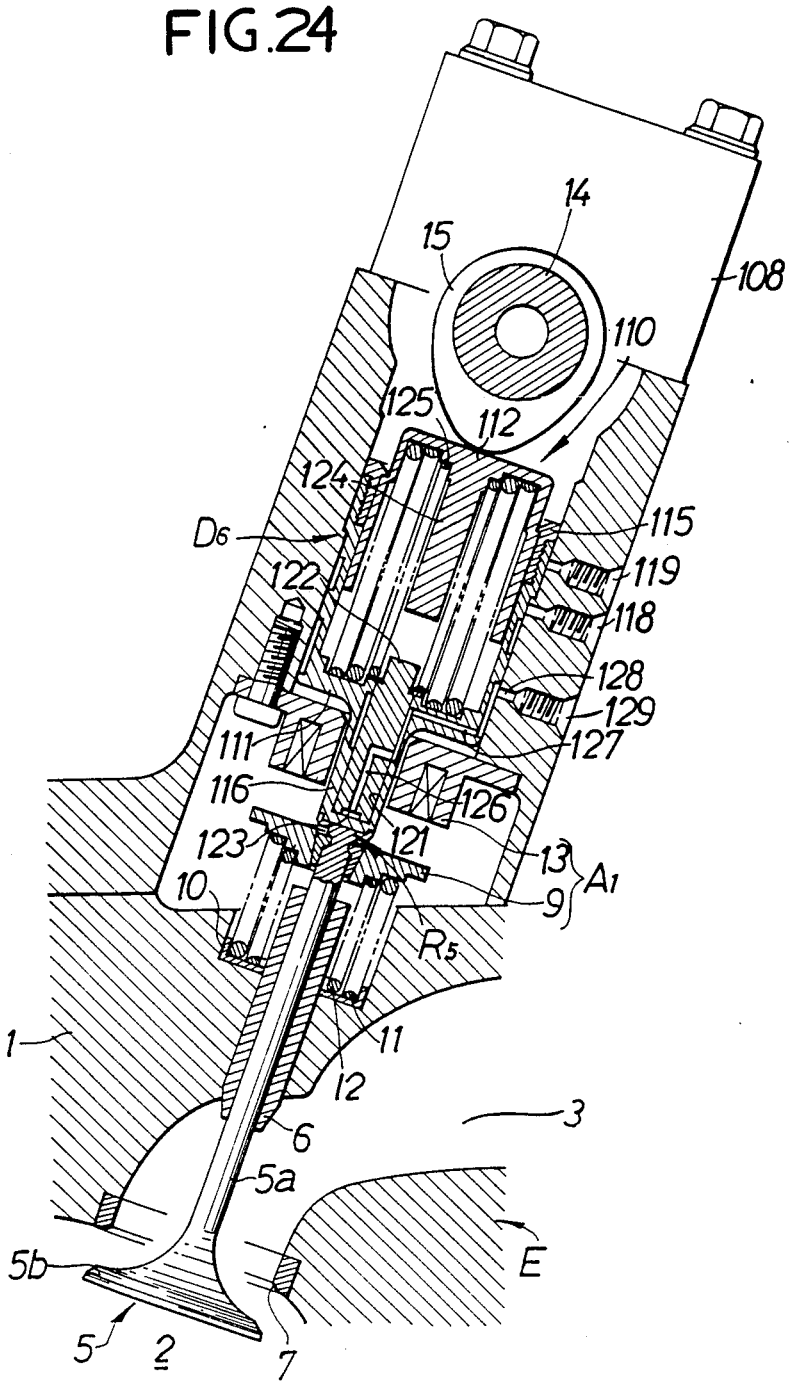

With the ninth embodiment, if the closed position of the intake valve 5 is maintained by the electromagnetic actuator A1, the intake valve 5 can be retained in its closed state, as shown in FIG. 23, irrespective of the turned position of the intake cam 15. Then, if maintaining of the closed position by the electromagnetic actuator A1 is released, the accumulated spring forces of the lifter springs 113 and 114 cause the intake valve 5 to be opened as shown in FIG. 24. When the amount of lift of the intake valve 5 becomes near a maximum during opening operating of the intake valve 5, the hydraulic pressure is confined in the hydraulic chamber 117 in the damper mechanism D6 and leaks through a clearance between the lower lifter portion 111 and the cylindrical support 106 Accordingly, in a region where the energy released from the lifter springs 113 and 114 is larger, the opening of the intake valve 5 is moderated by a buffering effect of the damper mechanism D6.

Figure 25:
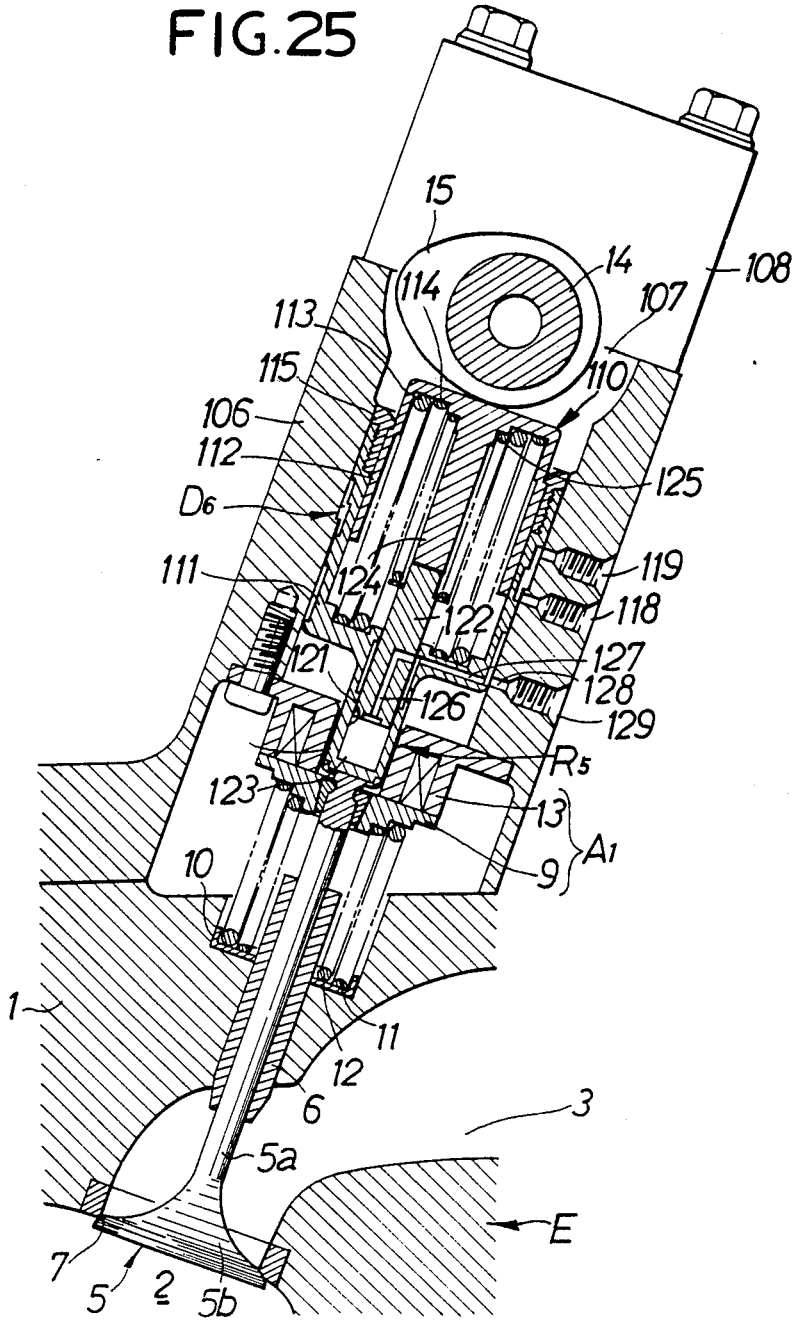
Figure 26:
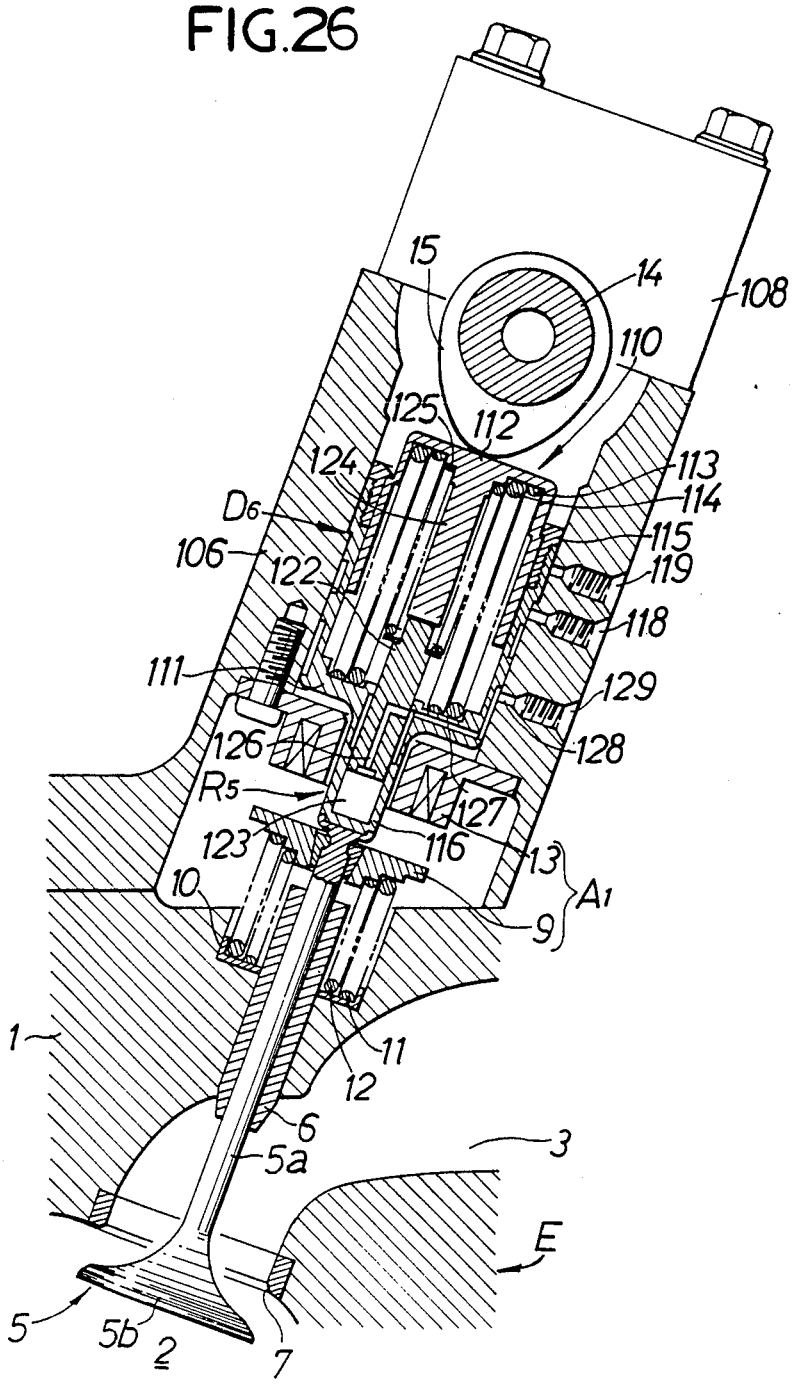

Further, if a hydraulic pressure is supplied into the hydraulic chamber 123 in the lock mechanism R5, the locking member 122 is moved up to abut against the abutment pin 124 as shown in FIG. 25, thereby inhibiting the downward movement of the upper lifter portion 112 relative to the lower lifter portion 111. Therefore, if the upper lifter portion 112 is urged downwardly by the intake cam 15 as shown in FIG. 26, the lower lifter portion 111 is also driven downwardly in a one piece, so that the intake valve 5 can be driven to be opened and closed in correspondence to the profile of the intake cam 15.

Even with the ninth embodiment, it is possible to provide an effect similar to those of the individual previous embodiments.

Figure 27:
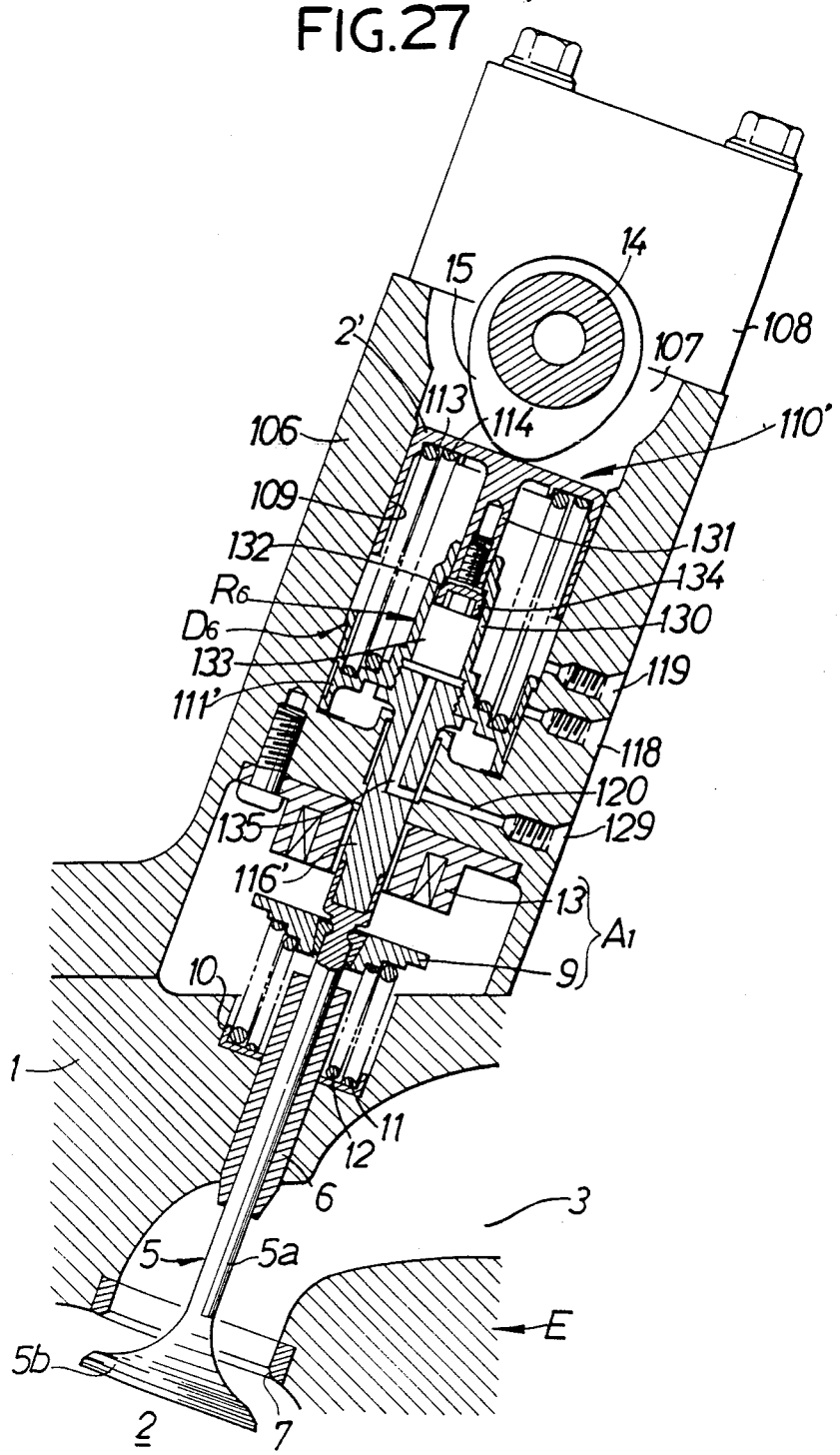
FIG. 27 is a longitudinal sectional side view of a tenth embodiment With a lock mechanism being operative.

FIG. 27 illustrates a tenth embodiment of the present invention, wherein like reference numerals are used to designate portions corresponding to those in the ninth embodiment.

A valve lifter 110' as valve driving means comprises a lower lifter portion 111' slidably received in the hollow cylinder portion 109 in the cylindrical support 106, a upper lifter portion 112' slidably received in the hollow cylinder portion 109, and a pair of lifter springs 113 and 114 interposed between the lower and upper lifter portions 111' and 112'. A lock mechanism R6 is interposed between the lower and upper lifter portions 111' and 112'.

A projecting pin 116' abutting against the upper end of the intake valve 5 is threadedly connected at its upper end to a central portion of the lower lifter portion 111'. An upwardly extending cylindrical portion 130 is also coaxially mounted on a central upper portion of the lower lifter portion 111', and a pin 131 provided to project on a central lower portion of the upper lifter portion 112' which is in slide contact with the intake cam 15 is slidably received in the cylindrical portion 130. A threaded member 134 is threadedly attached to a leading end of the pin 131 and adapted to engage a locking step of shoulder 132 provided on an upper end of the cylindrical portion 130. Thus, the relative movement of the lower and upper lifter portions 111' and 112' away from each other is restricted by engagement of the threaded member 134 with the locking step or shoulder 132.

The lock mechanism R6 comprises a hydraulic chamber 133 defined within the cylindrical portion 139 between the upper end of the projecting pin 116' and a lower end of the pin 131, so that supplying of a hydraulic pressure into the hydraulic chamber 133 inhibits the downward movement of the pin 131 and thus the upper lifter portion 112' relative to the lower lifter portion 111'.

An oil passage 135 is provided in the projecting pin 116' to communicating with the hydraulic chamber 133 and is normally in communication with the an oil passage 128 made in the cylindrical support 106.

Even with this tenth embodiment, it is possible to provide an effect similar to that in the previous ninth embodiment.

Figure 28:
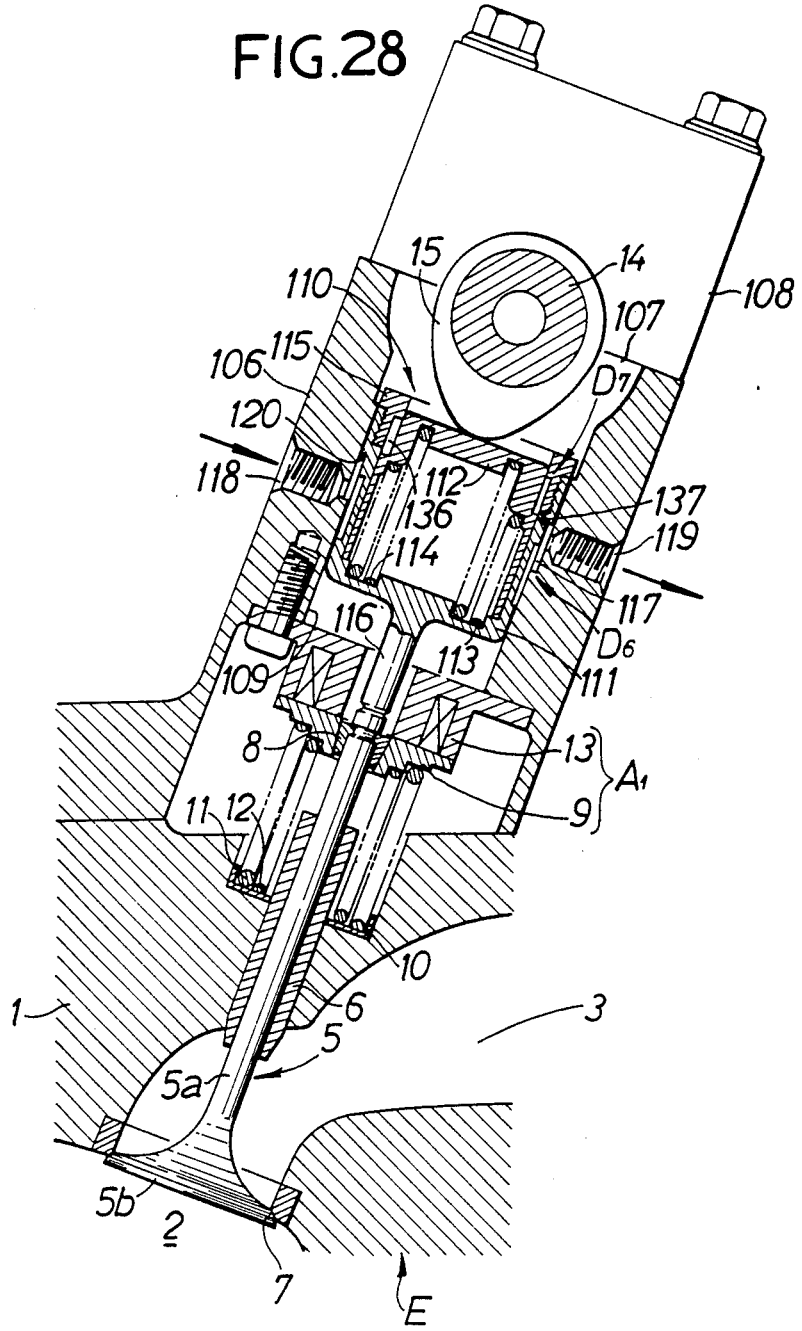
Figure 29:
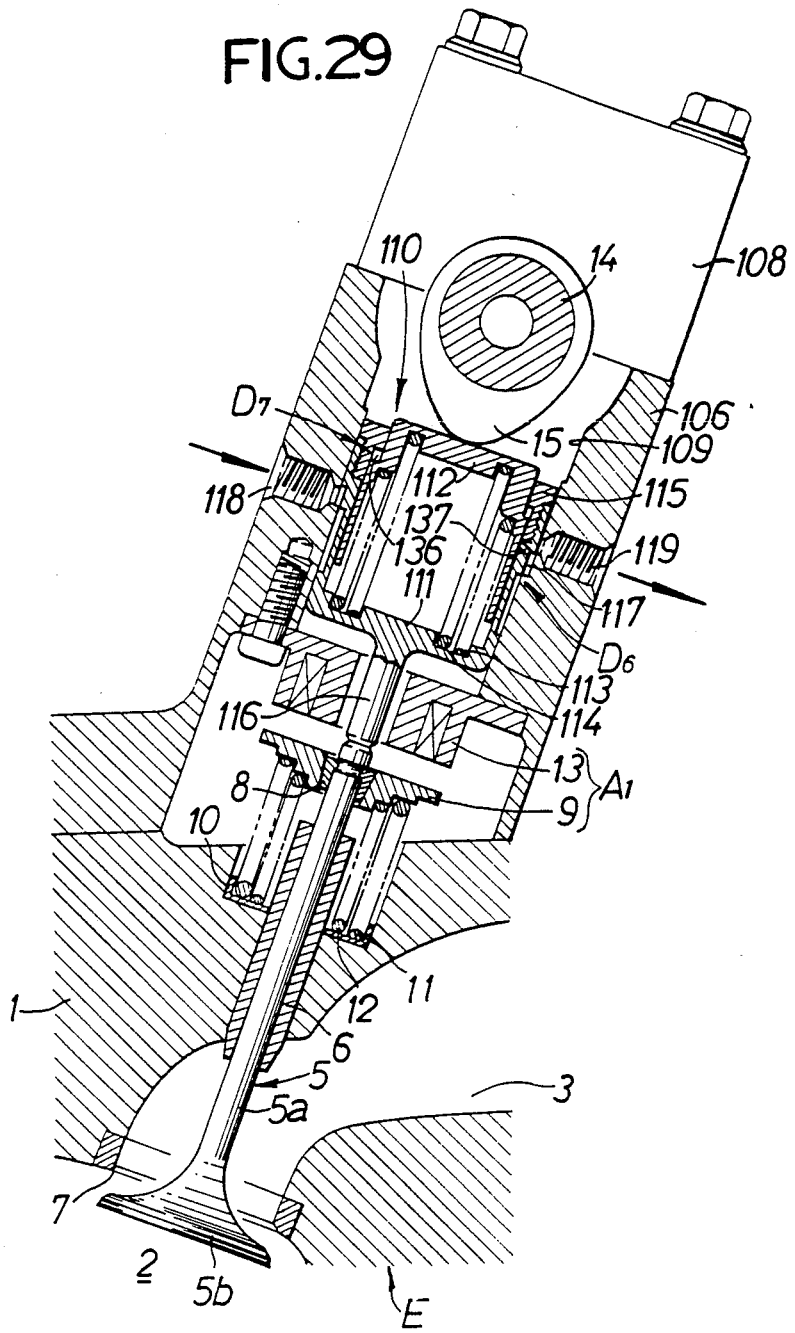
Figure 30:
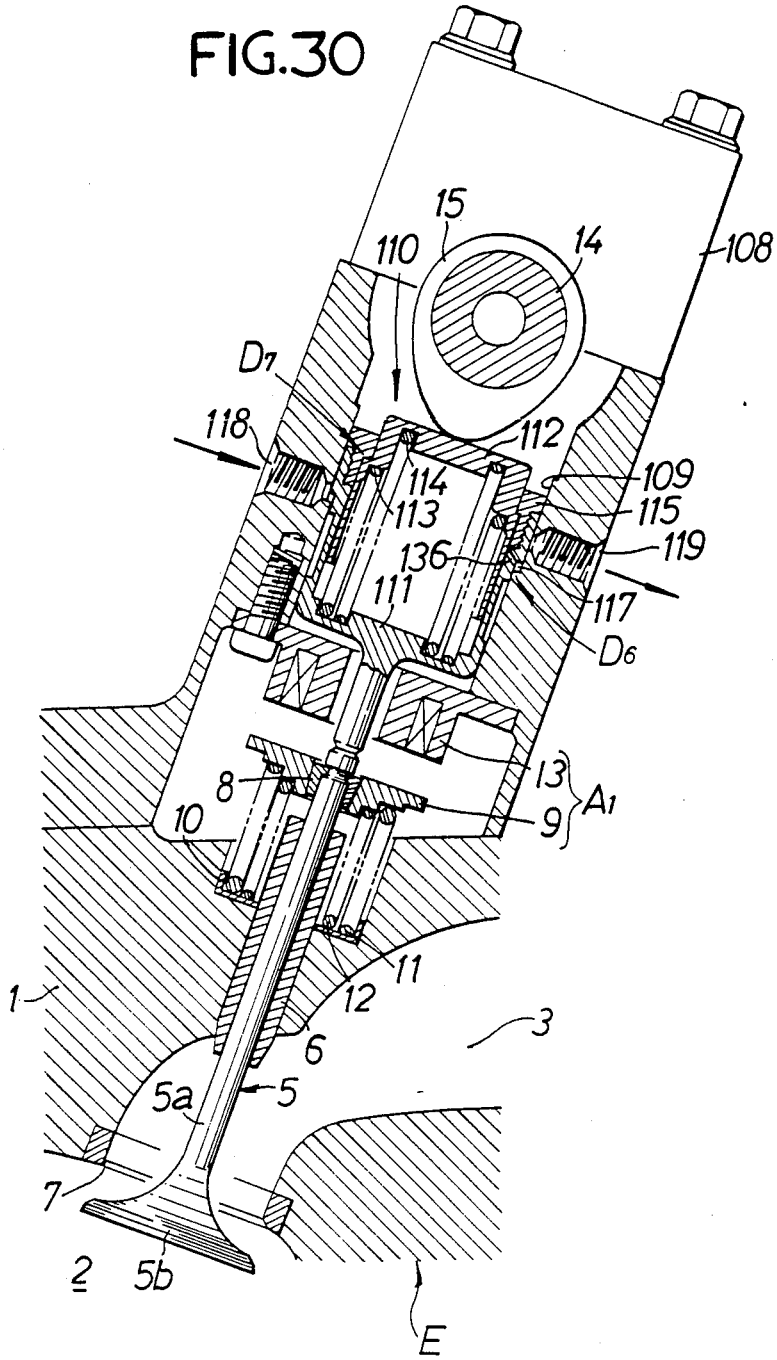

FIGS. 28, 29 and 30 illustrate an eleventh embodiment of the present invention, wherein like reference numerals designate portions corresponding to those in the previous ninth embodiment.

In the eleventh embodiment, a damper mechanism D7 is provided in addition to the damper mechanism D6 of the ninth embodiment. Specifically, the damper mechanism D6 is disposed between the lower lifter portion 111 and the cylindrical support 106, while the damper mechanism D7 is disposed between the lower lifter portion 111 and the upper lifter portion 112.

The damper mechanism D7 comprise a hydraulic chamber 136 provided between a set nut 115 integral with the lower lifter portion 111 and the upper lifter portion 112. The hydraulic chamber is communicatable with an oil supply port 118 through a communication passage 137 made in the lower lifter portion 111. Moreover, the communication passage 137 is made in the lower lifter portion 111 to communicate with the oil supply passage 118 when the upper lifter portion 112 is in a position in which it has been forced down at a maximum while maintaining the intake valve 5 closed, and to block such communication with the oil supply passage 118 when the lower lifter portion 111 is forced downwardly with the upper lifter portion 112 in its lowermost position.

With the eleventh embodiment, if the closed position of the intake valve 5 is maintained by the electromagnetic actuator A1, the intake valve 5 can be held at its closed state irrespective of the turned positions of the intake cam 15, as shown in FIG. 28, and during this time, each of the hydraulic chambers 117 and 136 in both damper mechanisms D6 and D7 is filled up with a hydraulic pressure.

Then, if the maintaining of the closed position by the electromagnetic actuator A1 is released, the intake valve 5 is opened by accumulated spring forces of the lifter springs 113 and 114, as shown in progress in FIG. 29. As the intake valve 5 is opened, a hydraulic pressure is confined in the hydraulic chamber 136 in the damper mechanism D7. As such hydraulic pressure leaks through clearances between the set nut 115 and the upper lifter portion 112 and between the lower and upper lifter portions 111 and 112, the lower lifter portion 111 is forced down and hence, the opening of the intake valve 5 is moderated. Such buffering effect of the damper mechanism D7 is effective over the entire region of lift of the intake valve 5.

In addition, when the amount of lift of the intake valve 5 is near to the maximum as shown in FIG. 30, a hydraulic pressure is confined in the hydraulic chamber 117 and leaks through the clearance between the lower lifter portion 111 and the cylindrical support 106. Thus, opening of the intake valve 5 is moderated by the buffering effects of the damper mechanisms D7 and D6 in a region of a larger energy discharged from the lifter spring 113 and 114.

FIGS. 31 to 34 illustrate a twelfth embodiment of the present invention, wherein like reference numerals are used to designate portions corresponding to those of the individual previous embodiments.

Between the intake cam 15 and the intake valve 5 which are operatively interconnected through the valve driving means 16, there are interposed an electromagnetic actuator A1 as valve-closed position retainer means for maintaining the intake valve 5 in its closed position, and an electro-magnetic actuator A2 as valve-opened position retainer means for maintaining the intake valve 5 in the open position. More specifically, an annular electromagnet 140 is secured to the cylinder head 1 in an opposed relation to the lower surface of the spring retainer 9 to surround the valve stem 5*a* of the intake valve 5 and constitutes an electromagnetic actuator A2 in cooperation with the magnetic element 9 which also serves as the spring retainer. The magnetic element 9 is contracted to the electromagnet 140 by excitation of a solenoid of the electromagnet 140, and the attracting force of the electromagnetic actuator A2 is set to be larger than the spring force of the valve spring 11. Accordingly, when the electromagnet 140 is excited in opening the intake valve 5, the opened position of the intake valve 5 is maintained regardless of rotation of the valve operating cam shaft 14.

Figure 31:
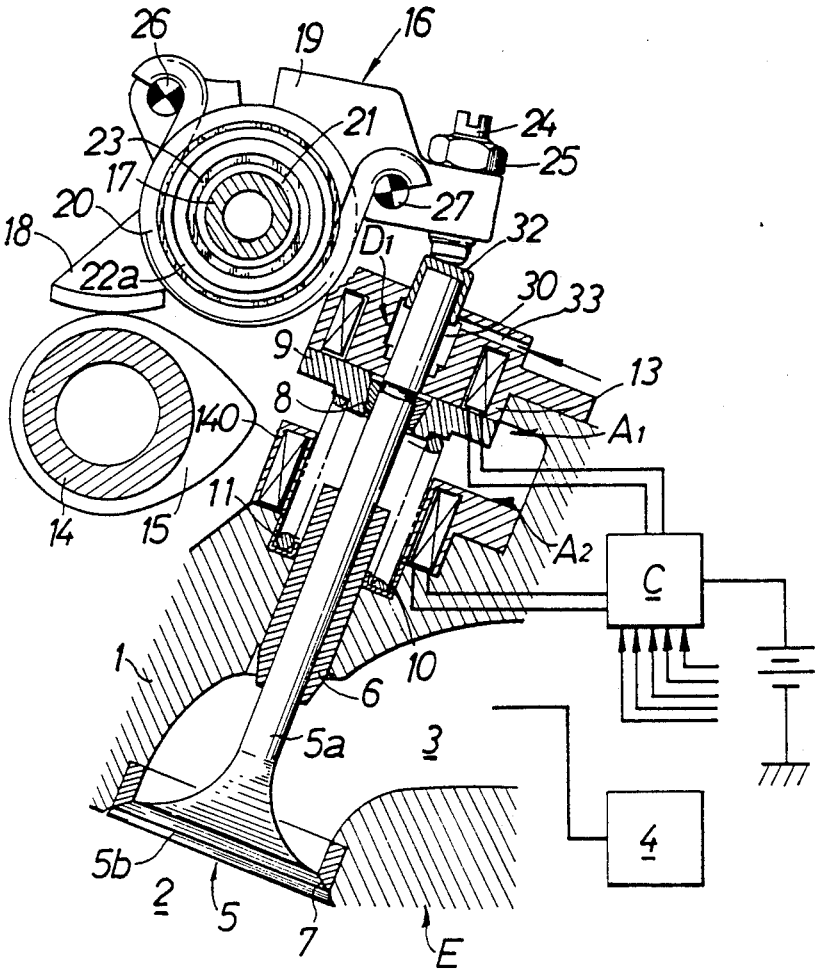
Figure 33:
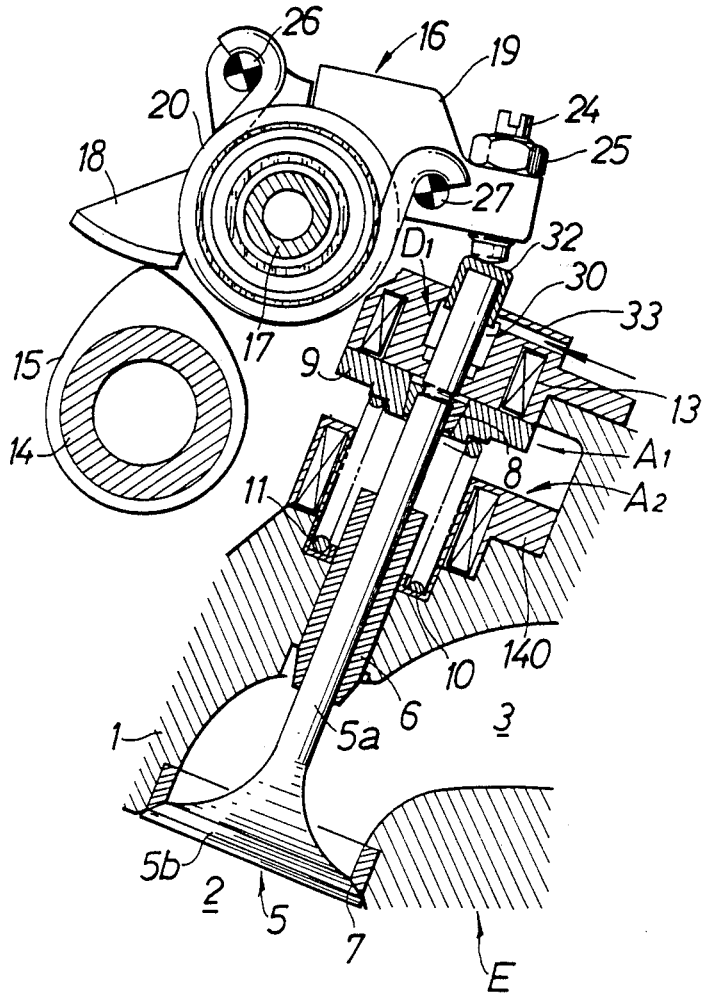

The operation of the twelfth embodiment will be described below. When the engine is in a particular operation, for example, in a lower load operation, the electromagnet 13 is energized under a control by the control circuit C to attract the magnetic element 9 to the electromagnet 13, while the circular base portion of the intake cam 15 is sliding on the first rocker arm 18 as shown in FIG. 31, i.e., before the intake valve 5 becomes lifted. By doing so, the first rocker arm 18 is only swung while twisting the torsion springs 20, as shown in FIG. 33. The intake valve 5 is maintained at the closed position, and the opening force provided by the intake cam 15 is accumulated by the torsion springs 20.

Figure 32:
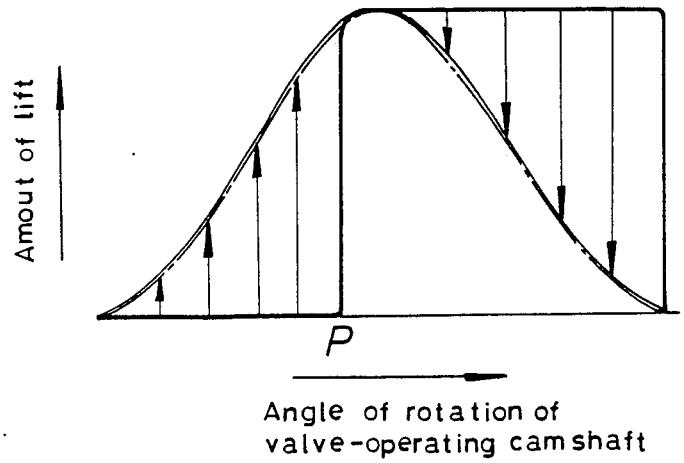
Figure 34:
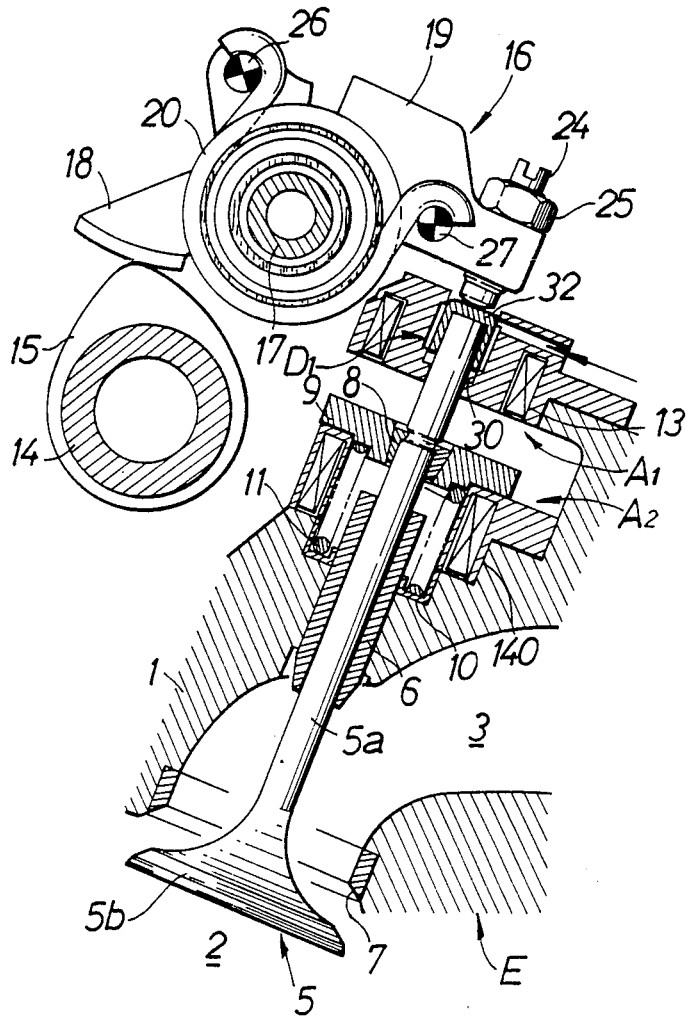

If the electromagnet 13 is deenergized when the valve-operating cam shaft 14 continues to rotate, so that the angle of rotation reaches, for example, near to a point P shown in FIG. 32, i.e., just short of a point where the amount of lift provided by the intake cam 15 becomes maximum, the force of attracting the magnetic element 9 is released. This causes the valve-opening force accumulated by the torsion springs 20 to be suddenly released, so that the intake valve 5 is suddenly opened by the repulsive forces of the torsion springs 20 as shown in FIG. 34, and the amount of lift rectilinearly increases as indicated by a bold solid line in FIG. 32. This permits a fuel air mixture flowing in the intake system to flow into the combustion chamber 2 quickly, so that the intake or suction mixture flowing from the intake system into the combustion chamber 2 becomes a supercharged condition under a higher inertial effect. Thus, an increased amount of the intake mixture is supplied into the combustion 2 to achieve a supercharging effect under a lower load operational condition, thereby providing an improvement in power.

When the amount of lift of the intake valve 5 has become maximum, the electromagnet 140 is energized under a control by the control circuit C to attract the magnetic element 9 to the electromagnet 140. This operates the electromagnetic actuator A2, so that the intake valve 5 is maintained at its opened position and remains opened irrespective of turned positions of the intake cam 15. When the excitation of the electromagnet 140 is then released, the intake valve 5 is operated to be closed by the spring force of the valve spring 11 independently of the cam profile. After the valve stem 8*a* has abutted against the tappet screw 24 of the valve-driving means 16, the intake valve 5 is closed in a usual curve of lift by the coaction of the intake cam 15 and the valve spring 11.

In this manner, the timings of opening and closing the intake valve 5 can be set at any points by the control of change over of the retained state and the retaining-released state provided by the electromagnetic actuators A1 and A2, and an appropriate valve operating control can be carried out depending upon the operational condition of the engine.

It is to be noted that the retaining by the electromagnetic actuators A1 and A2 can be conducted at any timing, as shown in a thin solid line in FIG. 32, regardless of the operational condition of the engine. That is, the electromagnetic actuators A1 and A2 make it possible to change the valve-opening and closing timings at any point between from a point just before the start of cam lifting to a point of the maximum amount of lift, as well as between from the point of the maximum amount of lift to a point just before the completion of cam lifting. Alternatively, if the energization of both electromagnetic actuators A1 and A2 is normally interrupted, opening and closing timings substantially along the cam profile may be obtained. Further alternatively, if the construction is such that the relative swinging movements of the rocker arms 18 and 19 are blocked, opening and closing timings surely along the cam profile may be obtained.

Figure 35:
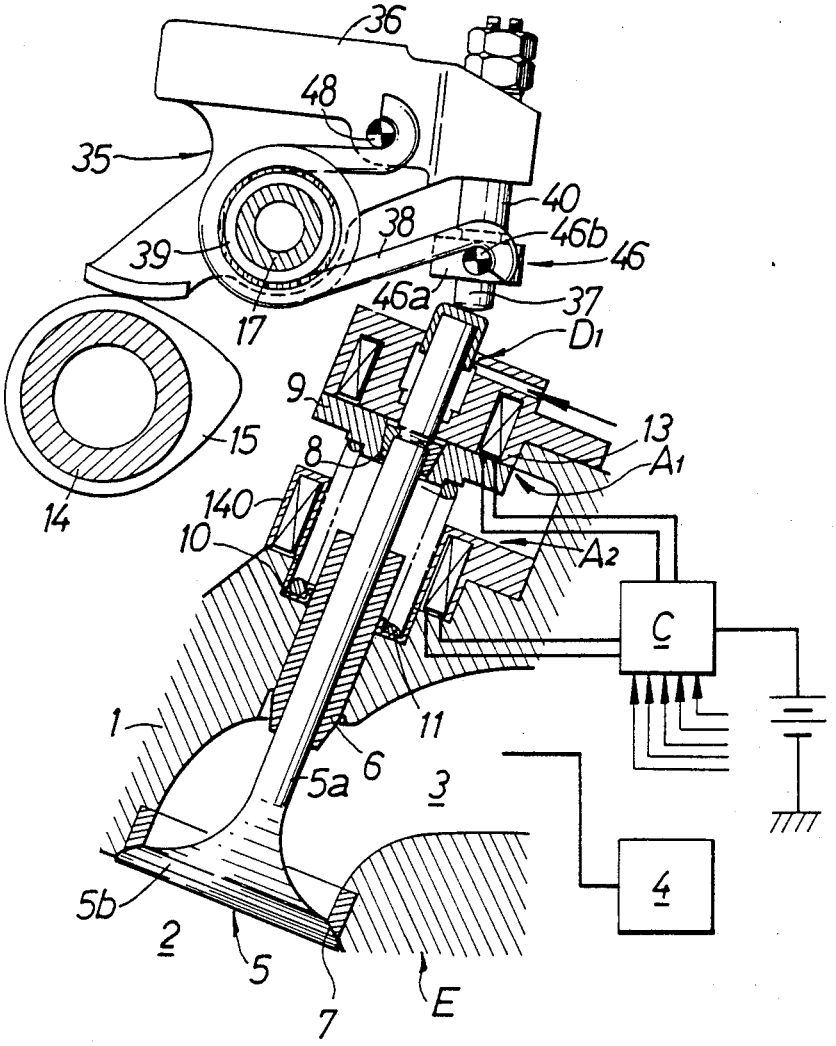
FIG. 35 is a longitudinal sectional side view of a thirteenth embodiment of the present invention.

FIG. 35 illustrates a thirteenth embodiment of the present invention, wherein like reference numerals designate portions corresponding to those in the individual previous embodiments.

Valve driving means 35 is interposed between the intake valve 5 and the intake cam 16. An electromagnetic actuator A1 is comprised of the upper surface of the spring retainer 9 and the electromagnet 13, while an electromagnetic actuator A2 is comprised of the lower surface of the spring retainer 9 and the electromagnet 140. The attracting force of the first actuator A1 and the spring force of the valve spring 11 are set to larger than the repulsive forces of the torsion springs 38, while the attracting force of the electromagnetic actuator A2 is set to be larger than the spring force of the valve spring 11.

With the thirteenth embodiment, energization of the electromagnet 13 of the electromagnetic actuator A1 enables the intake valve 5 to be retained at its closed state, and controlling of the timing of releasing such retained state enables the timing of opening the intake valve 5 to be controlled. On the other hand, electromagnetic actuator A2 makes it possible to maintain the opened state of the intake valve 5, and controlling of the timing of releasing such retained state enables the timing of closing the intake valve 5 to be controlled. Accordingly, it is possible to provide an effect similar to that of the previous twelfth embodiment.

Figure 36:
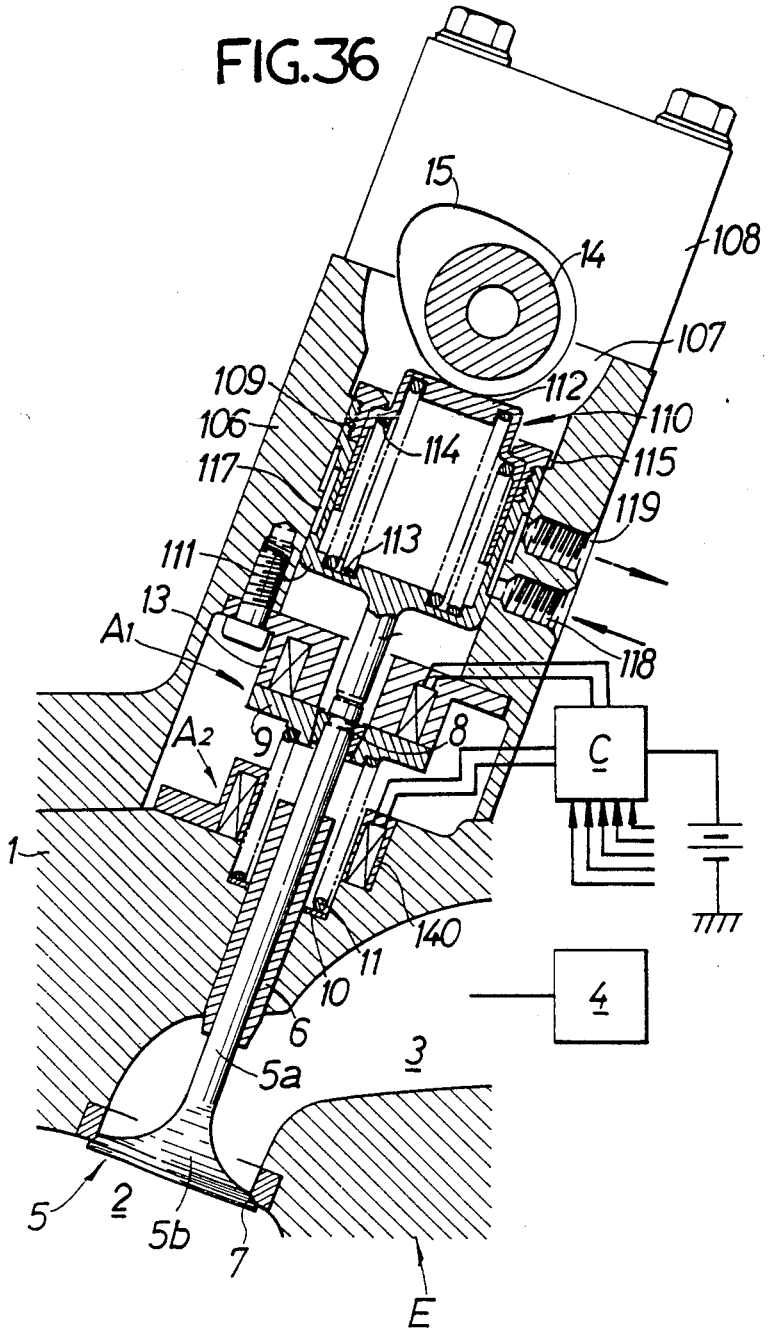
FIG. 36 is a longitudinal sectional side view of a fourteenth embodiment of the present invention.

FIG. 36 illustrates a fourteenth embodiment of the present invention, wherein like reference numerals denote portions corresponding to those in the individual previous embodiments.

As in the previously-described twelfth and thirteenth embodiments, the electromagnet 13 is fixed mounted on the lower portion of the cylindrical support 106 containing the valve lifter 110 and constitutes an electromagnetic actuator A1 by cooperation with the upper surface of the spring retainer 9, and the electromagnet 140 is also fixedly mounted on the cylinder head 1 and constitutes the electro-magnetic actuator A2 by cooperation with the lower surface of the spring retainer 9.

Again with the fourteenth embodiment, the electromagnetic actuator A1 makes it possible to maintain the closed position of the intake valve 5 to retain the intake valve 5 in its closed state, while the electromagnetic actuator A2 makes it possible to maintain the opened state of the intake valve 5', thus providing an effect similar to those in the above-described twelfth and thirteenth embodiments.

Although the system according the present invention has been described as applied in an intake valve opening and closing mechanism for an internal combustion engine in each of the above-described embodiments, it will be understood that the system can be also applied in an exhaust valve opening and closing mechanism. In this case, sudden opening of an exhaust valve at an exhaust stroke permits a pressurized exhaust gas to flow to an exhaust system quickly. This allows the exhaust inertia to be increased to improve the exhaust efficiency, thereby providing an improvement in power.

What is claimed is:

1. A valve operation control system in an internal combustion engine, comprising an engine valve openably and closably supported on an engine body, a valve spring for biasing said engine valve in a valve-closing direction, and valve driving means interposed between a valve-operating cam and the engine valve to transmit a force in the valve-opening direction provided by the valve-operating cam to the engine valve, wherein said valve driving means includes a valve-opening resilient member for exhibiting a repulsive force in a direction to open said engine valve, and said system includes closed-position retaining means interposed between said engine valve and said valve operating cam for retaining the engine valve in its closed position, with any valve-opening force provided by the valve-operating cam being accumulated by the valve-opening resilient member, said closed-position retaining means being arranged to be switchable between a retaining state and a releasing state during an opening cycle of said engine valve to control the timing of opening said engine valve depending upon the operational condition of the engine and wherein said closed-position retaining means comprises an electromagnetic actuator.

2. A valve operation control system in an internal combustion engine according to claim 1, wherein said valve driving means is provided with a lock mechanism adapted to block the resilient operation of the valve-opening resilient member.

3. A valve operation control system in an internal combustion engine according to claim 1, wherein said valve driving means comprises a first rocker arm closer to the valve-operating cam, a second rocker arm closer to the engine valve and swingable about a common axis with the first rocker arm, and a valve-opening resilient member interposed between the rocker arms.

4. A valve operation control system in an internal combustion engine according to claim 1, wherein said valve driving means comprises a rocker arm, a sliding plunger slidably carried on the rocker arm for sliding movement while abutting against either of the valve-operating cam or engine valve, and a valve-opening resilient member interposed between the rocker arm and the sliding plunger.

5. A valve operation control system in an internal combustion engine according to claim 1, wherein means are provided for controlling said electromagnetic actuator in response to signals indicating operating conditions of the engine including a speed of revolution of the engine, a temperature of the engine, a throttle opening degree of the engine, and an amount of intake air to the engine.

6. A valve operation control system in an internal combustion engine according to claim 1, wherein said valve driving means comprises an upper lifter portion closer to the valve-operating cam, a lower lifter portion closer to the engine valve, said upper and lower lifter portions being fitted with each other, and a valve-opening resilient member interposed between said upper and lower lifter portions for exhibiting a spring force in a direction to move said upper and lower lifter portions away from each other.

7. A valve operation control system in an internal combustion engine according to claim 1, further including a damper mechanism provided between either one of the engine valve and an interlocking member operatively connected to said engine valve and a stationary guide member for guiding the operation of said one of said engine valve and the interlocking member, said damper mechanism being adapted for moderating the opening of the engine valve by a repulsive force of the valve-opening resilient member.

8. A valve operation control system in an internal combustion engine according to claim 7, wherein said damper mechanism comprises a hydraulic chamber capable of limiting the amount of leak and defined between a stepped portion or shoulder formed at an upper portion of the engine valve and the guide member for guiding the operation of the engine valve.

9. A valve operation control system in an internal combustion engine according to claim 7, wherein said valve driving means comprises a lower lifter portion closer to the engine valve, an upper lifter portion slidably fitted in said lower lifter portion, and a valve-opening resilient member interposed between said lower and upper lifter portions, and said damper mechanism comprises a hydraulic chamber capable of limiting the amount of leak and defined between the lower lifter portion serving as an interlocking member and a cylindrical support serving as the guide member and fixedly mounted on a cylinder head to guide the movement of said lower lifter portion.

10. A valve operation control system in an internal combustion engine according to claim 1, further including valve opened position retaining means interposed between the engine valve and the valve-operating cam and arranged to be switchable between a retaining state and a releasing state to control the timing of closing the engine valve.

11. A valve operation control system in an internal combustion engine according to claim 10, wherein said valve-opened position retaining means comprises an electro-magnetic actuator.

12. A valve operation control system in an internal combustion engine, comprising an engine valve openably and closably supported on an engine body, a valve spring for biasing said engine valve in a valve-closing direction, and valve driving means interposed between a valve-operating cam and the engine valve to transmit a force in the valve-opening direction provided by the valve-operating cam to the engine valve, wherein said valve driving means includes a valve-opening resilient member for exhibiting a repulsive force in a direction to open said engine valve, and said system includes closed-position retaining means interposed between said engine valve and said valve operating cam for retaining the engine valve in its closed position, with any valve-opening force provided by the valve-operating cam being accumulated by the valve-opening resilient member, said closed-position retaining means being arranged to be switchable between a retaining state and a releasing state to control the timing of opening said engine valve depending upon the operational condition of the engine, wherein said valve driving means comprises a rocker arm, a sliding plunger slidably carried on the rocker arm for sliding movement while abutting against either of the valve-operating cam or engine valve, a valve-opening resilient member interposed between the rocker arm and the sliding plunger, and an arm member fixedly mounted on the sliding plunger through a cotter, said arm member being provided with a locking portion for the valve-opening resilient member.

13. A valve operation control system in an internal combustion engine according to claim 12 further including valve-opened position retaining means interposed between the engine valve and the valve-operating cam and arranged to be switchable between a retaining state and a releasing state to control the timing of closing the engine valve.

14. A valve operation control system in an internal combustion engine according to claim 13, wherein said valve opened position retaining means comprises an electromagnetic actuator.

15. A valve operation control system in an internal combustion engine, comprising an engine valve openably and closably supported on an engine body, a valve spring for biasing said engine valve in a valve-closing direction, and valve driving means interposed between a valve-operating cam and the engine valve to transmit a force in the valve-opening direction provided by the valve-operating cam to the engine valve, wherein said valve driving means includes a valve-opening resilient member for exhibiting a repulsive force in a direction to open said engine valve, and said system includes closed-position retaining means interposed between said engine valve and said valve operating cam for retaining the engine valve in its closed position, with any valve-opening force provided by the valve-operating cam being accumulated by the valve-opening resilient member, said closed-position retaining means being arranged to be switchable between a retaining state and a releasing state to control the timing of opening said engine valve depending upon the operational condition of the engine, wherein said valve driving means comprises an upper lifter portion closer to the valve-operating cam, a lower lifter portion closer to the engine valve, said upper and lower lifter portions being fitted with each other, and a valve-opening resilient member interposed between said upper and lower lifter portions for exhibiting a spring force in a direction to move said upper and lower lifter portions away from each other, and further including valve-opened position retaining means interposed between the engine valve and the valve-operating cam and arranged to be switchable between a retaining state and a releasing state to control the timing of closing the engine valve.

16. A valve operation control system in an internal combustion engine according to claim 15, wherein said valve opened position retaining means comprises an electromagnetic actuator.

17. A valve operation control system in an internal combustion engine, comprising an engine valve openably and closably supported on an engine body, a valve spring for biasing said engine valve in a valve-closing direction, and valve driving means interposed between a valve-operating cam and the engine valve to transmit a force in the valve-opening direction provided by the valve-operating cam to the engine valve, wherein said valve driving means includes a valve-opening resilient member for exhibiting a repulsive force in a direction to open said engine valve, and said system includes closed-position retaining means interposed between said engine valve and said valve operating cam for retaining the engine valve in its closed position, with any valve-opening force provided by the valve-operating cam being accumulated by the valve-opening resilient member, said closed-position retaining means being arranged to be switchable between a retaining state and a releasing state to control the timing of opening said engine valve depending upon the operational condition of the engine, wherein said valve driving means is provided with a lock mechanism adapted to block the resilient operation of the valve-opening resilient member, said valve driving means comprises first and second driving members displacable relative to each other, and a valve-opening resilient member interposed between said driving members, and said lock mechanism is disposed between said both driving member and includes a hydraulic chamber adapted to provide a hydraulic pressure in a direction to block the relative displacement of the both driving members against a repulsive force of the valve-opening resilient member.

18. A valve operation control system in an internal combustion engine according to claim 17, further including a lock mechanism interposed between a first rocker arm closer to the valve-operating cam and serving as the first driving member and a second rocker arm serving as the second driving member and swingable about a common axis with said first rocker arm.

19. A valve operation control system in an internal combustion engine according to claim 17, further including a lock mechanism interposed between a lower lifter portion closer to the engine valve and serving as the first driving member and an upper lifter portion relatively movable relative to said lower lifter portion, closer to the valve-operating cam and serving as the second driving member.

20. A valve operation control system in an internal combustion engine according to claim 17, wherein said valve driving means comprises first and second driving members displacable relative to each other, and a valve-opening resilient member interposed between said both driving members, and said lock mechanism comprises a locking member engageable with one of said first and second driving members and disposed in the other driving member for movement between an engaged position and a disengaged position.

21. A valve operation control system in an internal combustion engine according to claim 20, wherein said lock mechanism comprises a locking portion provided in one of a first rocker arm closer to the valve-operating cam and serving as the first driving member and a second rocker arm swingable about a common axis with said first rocker arm, and a locking member disposed on the other of said first and second rocker arms for advancing and retreating movements between a position in which it engages said locking portion and a position with such engagement released.

22. A valve operation control system in an internal combustion engine according to claim 20, wherein said valve driving means comprises a rocker arm in slide contact with the valve-operating cam and serving as the first driving member, a sliding plunger serving as the second driving member and slidably carried on the rocker arm to abut against the engine valve, and a valve-opening resilient member interposed between said rocker arm and said sliding plunger, and said lock mechanism comprises a locking portion provided in said sliding plunger and a locking member disposed on the rocker arm for advancing and retreating movements between a position in which it engages said locking portion and a position with such engagement released.

23. A valve operation control system in an internal combustion engine according to claim 20, wherein said valve driving means comprises a rocker arm in slide contact with the valve-operating cam and serving as the first driving member, a sliding plunger serving as the second driving member and slidably carried on the rocker arm to abut against the engine valve, and a valve-opening resilient member interposed between said rocker arm and said sliding plunger, and said lock mechanism comprises a locking member carried on the rocker arm for swinging movement between a position in which it engages said sliding plunger and a position with such engagement released, an operating piston disposed in the rocker arm for advancing and retreating movements to urge said locking member in a direction to engage the sliding plunger, and a hydraulic chamber provided in said rocker arm to face a back of the operating piston in order to allow a hydraulic pressure to act on said operating piston.

24. A valve operation control system in an internal combustion engine, comprising an engine valve openably and closably supported on an engine body, a valve spring for biasing said engine valve in a valve-closing direction, and valve driving means interposed between a valve-operating cam and the engine valve to transmit a force in the valve-opening direction provided by the valve-operating cam to the engine valve, wherein said valve driving means includes a valve-opening resilient member for exhibiting a repulsive force in a direction to open said engine valve, and said system includes closed-position retaining means interposed between said engine valve and said valve operating cam for retaining the engine valve in its closed position, with any valve-opening force provided by the valve-operating cam being accumulated by the valve-opening resilient member, said closed-position retaining means being arranged to be switchable between a retaining state and a releasing state to control the timing of opening said engine valve depending upon the operational condition of the engine, wherein said valve driving means comprises a rocker arm, a sliding plunger slidably carried on the rocker arm for sliding movement while abutting against either of the valve-operating cam or engine valve, and a valve-opening resilient member interposed between the rocker arm and the sliding plunger, and further including valve-opened position retaining means interposed between the engine valve and the valve-operating cam and arranged to be switchable between a retaining state and a releasing state to control the timing of closing the engine valve.

25. A valve operation control system in an internal combustion engine according to claim 24, wherein said valve opened position retaining means comprises an electromagnetic actuator.

26. A valve operation control system in an internal combustion engine, comprising an engine valve openably and closably supported on an engine body, a valve spring for biasing said engine valve in a valve-closing direction, and valve driving means interposed between a valve-operating cam and the engine valve to transmit a force in the valve-opening direction provided by the valve-operating cam to the engine valve, wherein said valve driving means includes a valve-opening resilient member for exhibiting a repulsive force in a direction to open said engine valve, and said system includes closed-position retaining means interposed between said engine valve and said valve operating cam for retaining the engine valve in its closed position, with any valve-opening force provided by the valve-operating cam being accumulated by the valve-opening resilient member, said closed-position retaining means being arranged to be switchable between a retaining state and a releasing state to control the timing of opening said engine valve depending upon the operational condition of the engine, wherein said valve driving means comprises a first rocker arm closer to the valve-operating cam, a second rocker arm closer to the engine valve and swingable about a common axis with the first rocker arm, and a valve-opening resilient member interposed between the rocker arms, and further including valve-opened position retaining means interposed between the engine valve and the valve-operating cam and arranged to be switchable between a retaining state and a releasing state to control the timing of closing the engine valve.

27. A valve operation control system in an internal combustion engine according to claim 26, wherein said valve opened position retaining means comprises an electromagnetic actuator.

28. A valve operation control system in an internal combustion engine, comprising an engine valve openably and closably supported on an engine body, a valve spring for biasing said engine valve in a valve-closing direction, and valve driving means interposed between a valve-operating cam and the engine valve to transmit a force in the valve-opening direction provided by the valve-operating cam to the engine valve, wherein said valve driving means includes a valve-opening resilient member for exhibiting a repulsive force in a direction to open said engine valve, and said system includes closed-position retaining means interposed between said engine valve and said valve operating cam for retaining the engine valve in its closed position, which any valve-opening force provided by the valve-operating cam being accumulated by the valve-opening resilient member, said closed-position retaining means being arranged to be switchable between a retaining state and a releasing state to control the timing of opening said engine valve depending upon the operational condition of the engine, wherein said valve driving means includes a damper mechanism for buffering the valve-opening operation of the valve driving means by a repulsive force of the valve-opening resilient member.

29. A valve operation control system in an internal combustion engine according to claim 28, wherein said valve driving means comprises first and second driving members displacable relative to each other, and a valve-opening resilient member interposed between both the driving members, and said damper mechanism is provided at an impulse contact portion between both the driving members.

30. A valve operation control system in an internal combustion engine according to claim 29, further including a damper mechanism provided between a first rocker arm closer to the valve-operating cam and serving as the first driving member and a second rocker arm serving as the second driving member and swingable about a common axis with said first rocker arm, said damper mechanism comprising a piston slidably received in one of said first and second rocker arms, and a hydraulic chamber defined to face a back of the piston in order to exhibit a hydraulic pressure for forcing said piston into abutment against the other of said first and second rocker arms.

31. A valve operation control system in an internal combustion engine according to claim 29, further including a damper mechanism provided between a first rocker arm closer to the valve-operating cam and serving as the first driving member and a second rocker arm serving as the second driving member and swingable about a common axis with said first rocker arm, said damper mechanism comprising a slide hole made in one of said first and second rocker arms, a sphere slidably received in said slide hole, and a hydraulic chamber defined to face a back of the sphere in order to bring said sphere into abutment against the other of said first and second rocker arms; and further including a clearance defined between an outer surface of said sphere and an inner surface of said slide hole and adapted to permit leakage of a hydraulic pressure within the hydraulic chamber during movement of said sphere toward the interior of said slide hole.

32. A valve operation control system in an internal combustion engine according to claim 29, further including a damper mechanism provided between a rocker arm closer to the valve-operating cam and serving as the first driving member and a sliding plunger slidable carried on said rocker arm to abut against the engine valve and serving as the second driving member, said damper mechanism including a hydraulic chamber capable of limiting the amount of leak.

33. A valve operation control system in an internal combustion engine according to claim 29, further including a damper mechanism provided between a lower lifter portion closer to the engine valve and serving as the first driving member and an upper lifter portion slidably fitted in said lower lifter portion, closer to the valve-operating cam and serving as the second driving member, said damper mechanism including a hydraulic chamber capable of limiting the amount of leak.

* * * * *